US010307889B2

(12) United States Patent
Keipert

(10) Patent No.: US 10,307,889 B2
(45) Date of Patent: Jun. 4, 2019

(54) COATED ABRASIVE ARTICLE AND METHOD OF MAKING THE SAME

(71) Applicant: 3M INNOVATIVE PROPERTIES COMPANY, St. Paul, MN (US)

(72) Inventor: Steven J. Keipert, Houlton, WI (US)

(73) Assignee: 3M Innovative Properties Company, St. Paul, MN (US)

( * ) Notice: Subject to any disclaimer, the term of this patent is extended or adjusted under 35 U.S.C. 154(b) by 0 days.

(21) Appl. No.: 15/549,281

(22) PCT Filed: Mar. 17, 2016

(86) PCT No.: PCT/US2016/022884

§ 371 (c)(1),
(2) Date: Aug. 7, 2017

(87) PCT Pub. No.: WO2016/160357

PCT Pub. Date: Oct. 6, 2016

(65) Prior Publication Data

US 2018/0029194 A1 Feb. 1, 2018

Related U.S. Application Data

(60) Provisional application No. 62/181,612, filed on Jun. 18, 2015, provisional application No. 62/160,429, (Continued)

(51) Int. Cl.

| | |
|---|---|
| ***B24D 3/06*** | (2006.01) |
| ***B24D 3/28*** | (2006.01) |
| ***B24D 11/00*** | (2006.01) |

(52) U.S. Cl.

CPC ..... *B24D 11/001* (2013.01); *B24D 3/06* (2013.01); *B24D 3/28* (2013.01)

(58) Field of Classification Search

CPC ..... B24D 11/001; B24D 3/06; B24D 3/28; E21B 18/00; E21B 10/46; E21B 10/567; E21B 10/5676; E21B 10/5673

See application file for complete search history.

(56) References Cited

U.S. PATENT DOCUMENTS

| | | | |
|---|---|---|---|
| 1,910,444 | A | 5/1933 | Nicholson |
| 2,370,636 | A | 3/1945 | Carlton |

(Continued)

FOREIGN PATENT DOCUMENTS

| | | | |
|---|---|---|---|
| CN | 1774488 | A | 5/2006 |
| CN | 104440605 | A | 3/2015 |

(Continued)

OTHER PUBLICATIONS

"Calcined Alumina Powders", Datasheet, 2004, 2pgs.

(Continued)

*Primary Examiner* — Pegah Parvini

(74) *Attorney, Agent, or Firm* — Bradford B. Wright

(57) ABSTRACT

A coated abrasive article includes a backing, a make layer, crushed abrasive particles, and a size layer. The crushed abrasive particles include: 35 to 100 weight percent of initial crushed abrasive particles having a first composition and first size grade, wherein a majority of the initial crushed abrasive particles are platey crushed abrasive particles, and wherein each platey crushed abrasive particle has a respective length, width, and thickness; and 0 to 65 weight percent of crushed filler particles having a second composition and a second size grade. The first and second compositions and/or size grades are different. The coated abrasive article has a direction of intended use, a majority of the platey crushed abrasive particles of the coated abrasive article are positioned with their thickness oriented substantially paral- (Continued)

lel to the direction of intended use. A method of making the coated abrasive article is also disclosed.

8 Claims, 14 Drawing Sheets

Related U.S. Application Data filed on May 12, 2015, provisional application No. 62/140,262, filed on Mar. 30, 2015.

(56) References Cited

U.S. PATENT DOCUMENTS

| | | | | |
|---|---|---|---|---|
| 3,041,156 | A | 6/1962 | Rowse | |
| 4,314,827 | A | 2/1982 | Leitheiser | |
| 4,518,397 | A | 5/1985 | Leitheiser | |
| 4,623,364 | A | 11/1986 | Cottringer | |
| 4,652,275 | A | 3/1987 | Bloecher | |
| 4,734,104 | A | 3/1988 | Broberg | |
| 4,737,163 | A | 4/1988 | Larkey | |
| 4,744,802 | A | 5/1988 | Schwabel | |
| 4,770,671 | A | 9/1988 | Monroe | |
| 4,799,939 | A | 1/1989 | Bloecher | |
| 4,848,041 | A | 7/1989 | Kruschke | |
| 4,881,951 | A | 11/1989 | Wood | |
| 4,927,431 | A | 5/1990 | Buchanan | |
| 4,964,883 | A | 10/1990 | Morris | |
| 4,997,461 | A | 3/1991 | Markhoff-Matheny | |
| 5,009,675 | A | 4/1991 | Kunz | |
| 5,011,508 | A | 4/1991 | Wald | |
| 5,042,991 | A | 8/1991 | Kunz | |
| 5,049,165 | A | 9/1991 | Tselesin | |
| 5,078,753 | A | 1/1992 | Broberg | |
| 5,085,671 | A | 2/1992 | Martin | |
| 5,090,968 | A | 2/1992 | Fellow | |
| 5,092,910 | A | 3/1992 | deKok | |
| 5,108,463 | A | 4/1992 | Buchanan | |
| 5,137,542 | A | 8/1992 | Buchanan | |
| 5,139,978 | A | 8/1992 | Wood | |
| 5,152,917 | A | 10/1992 | Pieper | |
| 5,201,916 | A | 4/1993 | Berg | |
| 5,203,884 | A | 4/1993 | Buchanan | |
| 5,213,591 | A | 5/1993 | Celikkaya | |
| 5,219,462 | A | 6/1993 | Bruxvoort | |
| 5,227,104 | A | 7/1993 | Bauer | |
| 5,251,802 | A | 10/1993 | Bruxvoort | |
| 5,304,223 | A | 4/1994 | Pieper | |
| 5,328,716 | A | 7/1994 | Buchanan | |
| 5,352,254 | A | 10/1994 | Celikkaya | |
| 5,366,523 | A | 11/1994 | Rowenhorst | |
| 5,380,390 | A | 1/1995 | Tselesin | |
| 5,435,816 | A | 7/1995 | Spurgeon | |
| 5,453,106 | A | 9/1995 | Roberts | |
| 5,498,269 | A | 3/1996 | Larmie | |
| 5,500,273 | A | 3/1996 | Holmes | |
| 5,549,962 | A | 8/1996 | Holmes | |
| 5,560,745 | A | 10/1996 | Roberts | |
| 5,593,467 | A * | 1/1997 | Monroe | B24D 3/14 501/153 |
| RE35,570 | E | 7/1997 | Rowenhorst | |
| 5,672,097 | A | 9/1997 | Hoopman | |
| 5,695,533 | A | 12/1997 | Kardys | |
| 5,946,991 | A | 9/1999 | Hoopman | |
| 5,975,987 | A | 11/1999 | Hoopman | |
| 5,984,988 | A | 11/1999 | Berg | |
| 6,129,540 | A | 10/2000 | Hoopman | |
| 6,669,745 | B2 | 12/2003 | Prichard | |
| 6,702,650 | B2 | 3/2004 | Adefris | |
| 7,553,346 | B2 | 6/2009 | Welygan | |
| 8,034,137 | B2 | 10/2011 | Erickson | |
| 8,038,750 | B2 | 10/2011 | Pribyl | |
| 8,080,073 | B2 | 12/2011 | David | |
| 8,083,820 | B2 | 12/2011 | Kollodge | |
| 8,142,531 | B2 | 3/2012 | Adefris | |
| 8,142,532 | B2 | 3/2012 | Erickson | |
| 8,142,891 | B2 | 3/2012 | Culler | |
| 8,425,278 | B2 | 4/2013 | Culler | |
| 8,771,801 | B2 * | 7/2014 | Moren | B24D 18/00 427/470 |
| 2002/0019206 | A1 | 2/2002 | Deka | |
| 2005/0081455 | A1 | 4/2005 | Welygan et al. | |
| 2006/0026904 | A1 | 2/2006 | Woo | |
| 2006/0143989 | A1 | 7/2006 | Lindquist | |
| 2009/0165394 | A1 | 7/2009 | Culler | |
| 2009/0169816 | A1 | 7/2009 | Erickson | |
| 2011/0289854 | A1 * | 12/2011 | Moren | B24D 3/34 51/295 |
| 2012/0227333 | A1 | 9/2012 | Adefris | |
| 2013/0040537 | A1 | 2/2013 | Schwabel | |
| 2013/0125477 | A1 | 5/2013 | Adefris | |
| 2013/0344786 | A1 | 12/2013 | Keipert | |
| 2014/0106126 | A1 | 4/2014 | Gaeta | |

FOREIGN PATENT DOCUMENTS

| | | |
|---|---|---|
| KR | 10-0772034 | 10/2007 |
| WO | WO 2012-112305 | 8/2012 |
| WO | WO 2014/176108 A1 | 10/2014 |
| WO | WO 2014/210568 A1 | 12/2014 |

OTHER PUBLICATIONS

International Search Report for PCT International Application No. PCT/US2016/022884, dated Sep. 1, 2016, 3pgs.

Supplementary European Search Report for EP Application 16 77 3731, dated Nov. 20, 2018, 2 pages.

* cited by examiner

COATED ABRASIVE ARTICLE AND METHOD OF MAKING THE SAME

TECHNICAL FIELD

The present disclosure relates broadly to coated abrasive articles and methods of making and using them.

BACKGROUND

Coated abrasive articles are conventionally made by electrostatic coating (e-coat) the abrasive particles onto a make layer precursor (also known in the art as a "make coat") on a backing or drop coating the abrasive particles (also referred to in the art as abrasive grains) onto the make layer precursor, which is then cured to form a make layer resulting in a make layer (also termed a "make coat" in the art). A size layer precursor is disposed on the make layer and abrasive particles, and the size layer precursor is cured, and a size layer (also termed a "size coat" in the art). Optionally, but commonly, a supersize layer (which may contain, grinding aids, lubricants, etc.) is disposed on the size layer. The make and size layers generally include a thermosetting resin (e.g., phenolic resin, aminoplast resin, curable acrylic resin, cyanate resin, and combinations thereof).

Controlling the z-direction rotational orientation of the abrasive particles in a coated abrasive article is not possible using conventional electrostatic deposition methods to propel the abrasive particle vertically against the force of gravity onto a make layer by use of an electrostatic field thereby erectly applying the abrasive particles as shown in U.S. Pat. No. 2,370,636 (Carlton). The abrasive particles in the coated abrasive article generally have a random z-direction rotational orientation since the particle's rotation as it is being removed from the conveyor belt by the electrostatic field is random and uncontrolled. Similarly, in drop-coated abrasive articles, the particle's z-direction rotational orientation is random as the particles are fed from the hopper and fall by the force of gravity onto the make layer precursor.

Triangular shaped abrasive particles and abrasive articles using the triangular shaped abrasive particles are disclosed in U.S. Pat. No. 5,201,916 (Berg), U.S. Pat. No. 5,366,523 (Rowenhorst); and U.S. Pat. No. 5,984,988 (Berg). In one embodiment, the abrasive particles' shape was an equilateral triangle. Triangular shaped abrasive particles are useful in manufacturing abrasive articles having enhanced cut rates.

PCT International Publ. No. WO 2012/112305 A2 (Keipert) discloses coated abrasive articles manufactured through use of precision screens having precisely spaced and aligned non-circular apertures to hold individual abrasive particles in fixed positions that can be used to rotationally align a surface feature of the abrasive particles in a specific z-direction rotational orientation. In that method, a screen or perforated plate is laminated to an adhesive film and loaded with abrasive particles. The orientation of the abrasive particles could be controlled by the screen geometry and the restricted ability of the abrasive particles to contact and adhere to the adhesive through the screen openings. Removal of the adhesive layer from the filled screen transferred the oriented abrasive particles in an inverted fashion to an abrasive backing. The method relies on the presence of adhesive which may be cumbersome, prone to detackifying (e.g., due to dust deposits) over time, and which may transfer to the resultant coated abrasive article creating the possibility of adhesive transfer to, and contamination of, a workpiece.

U.S. Pat. Appln. Publ. 2013/0344786 A1 (Keipert) discloses a coated abrasive article having a plurality of formed ceramic abrasive particles, each having a surface feature. The plurality of formed ceramic abrasive particles is attached to a flexible backing by a make coat comprising a resinous adhesive forming an abrasive layer. The surface feature having a specified z-direction rotational orientation, and the specified z-direction rotational orientation occurs more frequently in the abrasive layer than would occur by a random z-direction rotational orientation of the surface feature. The term "formed abrasive particle" as used therein excludes randomly sized abrasive particles obtained by a mechanical crushing operation.

SUMMARY

The present disclosure demonstrates that improved performance can be achieved through control of the z-axis orientation of certain crushed abrasive particles. Crushed abrasive particles having a plate-like shape (e.g., a platelet or a flake) where a substantial portion of the particles have a thickness dimension that is small compared to the length and width dimensions can be oriented such that the thickness axes are all substantially aligned. Abrasive performance can be controlled by specifying the relative alignment of this axis with respect to the grinding axis (e.g., the direction that the abrasive and the surface being abraded travel with respect to each other during the grinding process).

For triangular shaped abrasive particles, inverted (base up) abrasive particles typically have a negative impact on the cut and life of the abrasive article, especially on metals such as stainless steel. Due to the high bearing area leading to low local pressure and poor fracture of these inverted abrasive particles, metal capping occurs, which leads to a premature end of cut life. In conventional coated abrasive products, the fraction of inverted abrasive particles is primarily a function of the mineral coat weight, and it is difficult to achieve high mineral coverage without inverted abrasive particles. This necessitates the use of very open coat constructions often with sub-optimum performance.

Electrostatically-coated crushed abrasive particles optimally attach to the make resin coated substrate such that their longest axis is normal to the substrate. Since they have no well-defined shape or opposed sharp and flat features, particle inversion at high coat weights does not apply and performance is good even for closed coat constructions. Drop-coated crushed abrasive particles perform similarly, except that lacking the orientation provided by the electrostatic field, their performance is generally lower.

The orientation of shaped abrasive particles with respect to the cutting direction is also important. The cutting efficiency and abrasive particle fracture mechanism of shaped abrasive particles varies with z-axis rotational orientation. With triangular abrasive particles, for improved cut and breakdown, it is generally preferred that the abrasive article and/or workpiece relative motion is such that the edge of the triangular abrasive particle is presented in the motion of cutting instead of the abrasive particle's face. If the face is presented to the direction of cutting, often the abrasive particle will fracture near its base and out of the plane of grinding.

When the orientation of platey crushed abrasive particles are similarly controlled, performance also changes when the platey crushed abrasive particles are rotated with respect to the grinding direction. Unexpectedly, the preferred orientation is opposite that of shaped particles. In the pressure regime most commonly encountered in coated abrasive applications the favored orientation is the "face on" particle orientation where the thinnest particle axis aligns with the grinding direction. Unexpectedly, this is the opposite of the best orientation observed for shaped abrasive particles.

The spacing of the abrasive particles in an abrasive article can also be important. This is generally true for both shaped and crushed particles. Conventional methods such as drop coating and electrostatic deposition provide a random distribution of spacing and particle clustering often results where two or more abrasive particles end up touching each other near the tips or upper surfaces of the abrasive particles. Uncontrolled clustering leads to decreased cutting performance due to local enlargement of bearing areas in those regions and inability of the abrasive particles in the cluster to fracture and breakdown properly during use because of mutual mechanical reinforcement. Clustering creates undesirable heat buildup compared to coated abrasive articles having more uniformly spaced abrasive particles.

In view of the above, it would be desirable to have alternative methods and apparatus that are useful for positioning and orienting abrasive particles in coated abrasive articles that are simple and cost-effective.

The present disclosure provides practical solutions to the above-described need, whereby a web or tooling containing cavities that are complementary to the size and shape of the abrasive particle, is filled with crushed abrasive particles containing a substantial fraction of platey crushed abrasive particles. The cavity shape controls the platey crushed abrasive particle alignment in the tooling. The controlled orientation platey crushed particle is subsequently inversely transferred to a make layer on a backing while maintaining the abrasive particle orientation and spacing induced by the tooling. Control of the grinding performance of resulting coated abrasive article can achieved through proper selection of the shape, size, spacing and orientation of the cavities in the replicated tooling.

Coated abrasive articles are useful for abrading a wide variety of materials and surfaces in the manufacturing of goods. As such, there continues to be a need for improving the cost, performance, or life of the coated abrasive article.

In one aspect, the present disclosure provides a coated abrasive article comprising:

a backing having first and second opposed major surfaces;

a make layer secured to at least a portion of the first major surface of the backing;

crushed abrasive particles comprising, on a total weight basis:

35 to 100 weight percent of initial crushed abrasive particles having a first composition and first size grade, wherein a majority of the initial crushed abrasive particles are platey crushed abrasive particles, and wherein each platey crushed abrasive particle has a respective length, width, and thickness; and 0 to 65 weight percent of crushed filler particles having a second composition and a second size grade, wherein:

i) the first and second compositions are different;

ii) the first and second size grades are different; or iii) both of i) and ii);

a size layer disposed on and secured to at least a portion of the make layer and platey crushed abrasive particles, wherein the coated abrasive article has a direction of intended use, and wherein a majority of the platey crushed abrasive particles are positioned with their thickness oriented substantially parallel to the direction of intended use.

In another aspect, the present disclosure provides a method of making a coated abrasive article, the method comprising the steps:

a) providing a production tool having a working surface, wherein the first major surface defines a plurality of oriented cavities, wherein the oriented cavities have respective elongate outer openings at the working surface, and wherein the respective elongate outer openings have respective maximum lengths oriented along respective longitudinal directions;

b) providing a backing having a make layer precursor disposed on at least a portion of a first major surface thereof;

c) disposing a plurality of initial crushed abrasive particles into at least a portion of the plurality of oriented cavities to form a loaded production tool, wherein the initial crushed abrasive particles have a first composition and first size grade, wherein a majority of the initial crushed abrasive particles are platey crushed abrasive particles, wherein each platey crushed abrasive particle has a respective length, width, and thickness, and wherein a majority of the platey crushed abrasive particles contained within the plurality of oriented cavities are respectively aligned substantially parallel to the longitudinal direction of the opening of the cavity in which it is disposed;

d) transferring at least a portion of the initial crushed abrasive particles disposed within the plurality of oriented cavities of the loaded production tool onto at least a portion of the make layer precursor;

e) at least partially curing the make layer precursor;

f) disposing a size layer precursor onto at least a portion of the make layer precursor and platey crushed abrasive particles; and g) at least partially curing the size layer precursor.

Advantageously, according to the present disclosure it is unexpectedly discovered that orientation of the platey crushed abrasive particles in a direction orthogonal to the directed of intended use improves cut performance, in contrast to typical behavior of triangular shaped abrasive particles which show better cut when aligned in the direction of intended use.

As used herein:

The term "length" refers to the maximum caliper dimension of an object.

The term "width" refers to the maximum caliper dimension of an object perpendicular to the length axis.

The term "thickness" refers to the caliper dimension of an object that is perpendicular to the length and width dimensions.

The term "caliper dimension" is defined as the distance between the two parallel planes restricting the object perpendicular to that direction.

The term "crushed abrasive particle" refers to an abrasive particle that is formed through a mechanical fracturing process, and specifically excludes abrasive particles that are evidently formed into shaped abrasive particles by a molding operation and then fractured. The material fractured to produce the crushed abrasive particle may be in the form of bulk abrasive or an abrasive precursor. It may also be in the form of an extruded rod or other profile or an extruded or otherwise formed sheet of abrasive or abrasive precursor. Mechanical fracturing includes for example roll or jaw crushing as well as fracture by explosive comminution.

The term "platey crushed abrasive particle", which refers to a crushed abrasive particle resembling a platelet and/or flake that is characterized by a thickness that is less than the width and length. For example, the thickness may be less than ½, ⅓, ¼, ⅕, ⅙, ⅐, ⅛, ⅑, or even less than 1/10 of the length and/or width. Likewise, the width may be less than ½, ⅓, ¼, ⅕, ⅙, ⅐, ⅛, ⅑, or even less than ⅒ of the length.

The term "shaped abrasive particle" refers to a ceramic abrasive particle with at least a portion of the abrasive particle having a predetermined shape that is replicated from a mold cavity used to form a precursor shaped abrasive particle which is sintered to form the shaped abrasive particle. Except in the case of abrasive shards (e.g., as described in U.S. Pat. No. 8,034,137 B2 (Erickson et al.)), the shaped abrasive particle will generally have a predetermined geometric shape that substantially replicates the mold cavity that was used to form the shaped abrasive particle. The term "shaped abrasive particle" as used herein excludes abrasive particles obtained by a mechanical crushing operation.

The term "essentially free of" means containing less than 5 percent by weight (e.g., less than 4, 3, 2, 1, 0.1, or even less than 0.01 percent by weight, or even completely free) of, based on the total weight of the object being referred to.

The term "number percent" means percent based on the total number of things being referred to.

The term "substantially parallel" means within +/−20 degrees of parallel, preferably +/−10 within degrees of parallel.

The term "direction of intended use" refers to a direction of motion of an abrasive article that would be ordinarily used during abrading a workpiece with a specified product. For example, in the case of a belt, the longitudinal machine direction of the belt would be the direction of intended use, while in the case of a disc, the rotational machine direction of the disc would be the direction of intended use.

Features and advantages of the present disclosure will be further understood upon consideration of the detailed description as well as the appended claims.

Figure 1A:
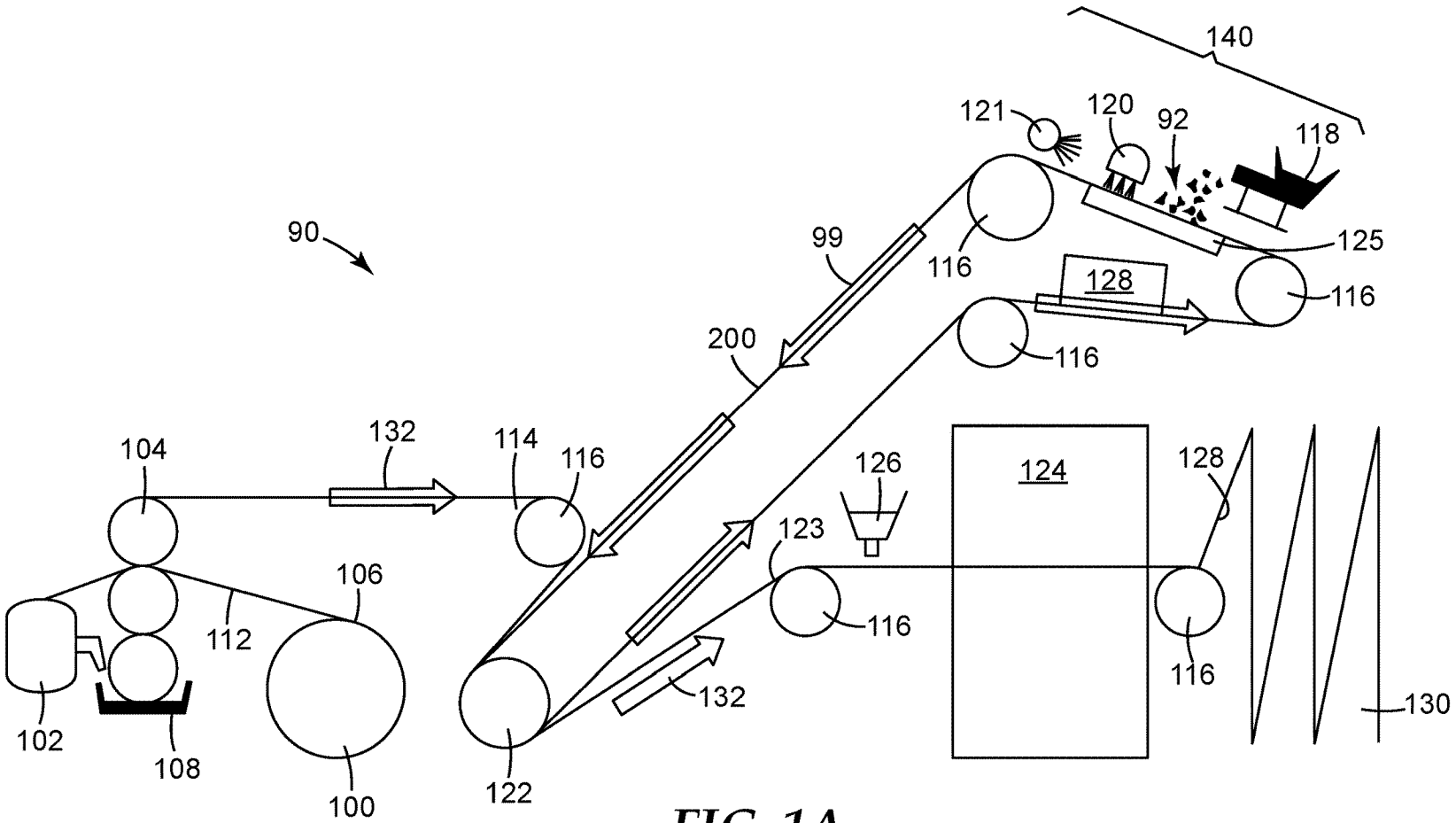
FIG. 1A is schematic view of an apparatus for making a coated abrasive article according to the present disclosure.

Repeated use of reference characters in the specification and drawings is intended to represent the same or analogous features or elements of the disclosure. It should be understood that numerous other modifications and embodiments can be devised by those skilled in the art which fall within the scope and spirit of the principles of the disclosure. The figures may not be drawn to scale.

DETAILED DESCRIPTION

Figure 2:
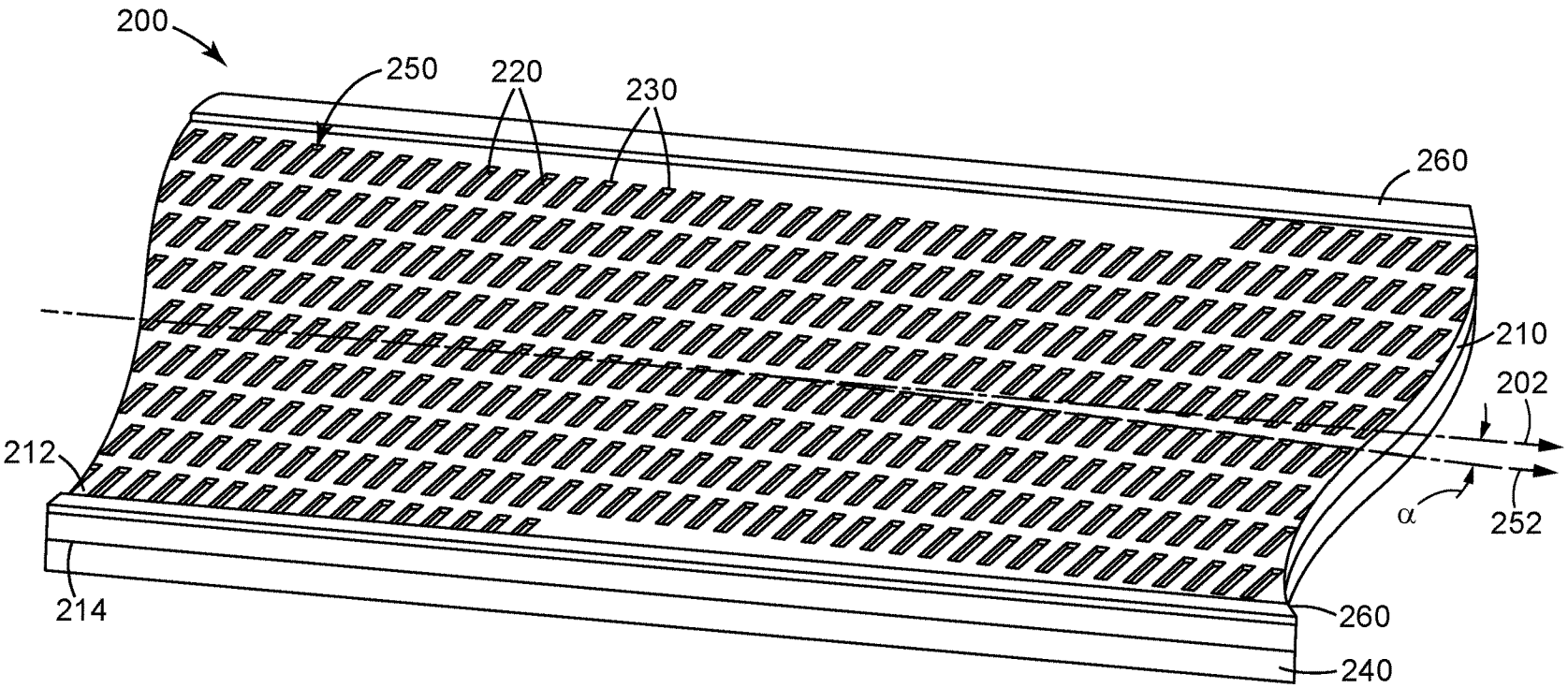
FIG. 2 is a schematic perspective view of an exemplary production tool 200 according to the present disclosure.

Referring now to FIG. 1A, and FIG. 2, an exemplary coated abrasive article maker apparatus 90 useful in practice of the present disclosure includes crushed abrasive particles 92 removably disposed within cavities 220 of a production tool 200 having a first web path 99 guiding the production tool through the coated abrasive article maker such that it wraps a portion of an outer circumference of an abrasive particle transfer roll 122. While in FIG. 1A, crushed abrasive particles 92 are shown as platey crushed abrasive particles it will be recognized that a numerical minority of the crushed abrasive particles may not be platey (e.g., they may be blocky) as long as a number majority of the crushed abrasive particles are platey crushed abrasive particles. The apparatus typically includes, for example, an unwind 100, a make layer precursor delivery system 102, and a make layer precursor applicator 104. These components unwind a backing 106, deliver a make layer precursor resin 108 via the make layer precursor delivery system 102 to the make layer precursor applicator 104 and apply the make layer precursor to a first major surface 112 of the backing. Thereafter, the resin-coated backing 114 is positioned by an idler roll 116 for application of the crushed abrasive particles 92 to the first major surface 112 coated with the make layer precursor resin 108. A second web path 132 for the resin-coated backing 114 guides the resin-coated backing through the coated abrasive article maker apparatus such that it wraps a portion of the outer circumference of the abrasive particle transfer roll 122 with the resin layer positioned facing the dispensing surface of the production tool that is positioned between the resin-coated backing 114 and the outer circumference of the abrasive particle transfer roll 122. Suitable unwinds, make layer precursor delivery systems, make layer precursor resins, coaters and backings are known to those of skill in the art. The make layer precursor delivery system 102 can be a simple pan or reservoir containing the make layer precursor resin or a pumping system with a storage tank and delivery plumbing to translate the make layer precursor resin to the needed location. The backing 106 can be a cloth, paper, film, nonwoven, scrim, or other web substrate. The make layer precursor applicator can be, for example, a coater, a roll coater, a spray system, or a rod coater. Alternatively, a pre-coated coated backing can be positioned by the idler roll 116 for application of the crushed abrasive particles to the first major surface.

As described hereinbelow, the production tool 200 comprises a plurality of cavities 220 having a generally complimentary shape to the intended platey crushed abrasive particle to be contained therein. An abrasive particle feeder 118 supplies at least some of the crushed abrasive particles to the production tool. Preferably, the abrasive particle feeder 118 supplies an excess of the crushed abrasive particles such that there are more crushed abrasive particles present per unit length of the production tool in the machine direction than the cavities can contain. Supplying an excess of crushed abrasive particles helps to ensure all cavities within the production tool are eventually filled with at least one abrasive particle (e.g., one, two or even three abrasive particle(s)). Since the bearing area and spacing of the crushed abrasive particles is often designed into the production tooling for the specific grinding application it is desirable to not have too many unfilled cavities. The abrasive particle feeder 118 is typically the same width as the production tool and supplies platey crushed abrasive particles across the entire width of the production tool. The abrasive particle feeder 118 can be, for example, a vibratory feeder, a hopper, a chute, a silo, a drop coater, or a screw feeder.

Optionally, a filling assist member 120 is provided after the abrasive particle feeder 118 to move the abrasive particles around on the surface of the production tool 200 and to help orientate or slide the crushed abrasive particles into the cavities 220. The filling assist member 120 can be, for example, a doctor blade, a felt wiper, a brush having a plurality of bristles, a vibration system, a blower or air knife, a vacuum box 125, or combinations thereof. The filling assist member moves, translates, sucks, or agitates the platey crushed abrasive particles on the dispensing surface 212 (top or upper surface of the production tool 200 in FIG. 1A) to place more abrasive particles into the cavities. Without the filling assist member, generally at least some of crushed abrasive particles dropped onto the dispensing surface 212 will fall directly into a cavity and no further movement is required but others may need some additional movement to be directed into a cavity. Optionally, the filling assist member 120 can be oscillated laterally in the cross machine direction or otherwise have a relative motion such as circular or oval to the surface of the production tool 200 using a suitable drive to assist in completely filling each cavity 220 in the production tool with at least one crushed abrasive particle. Typically, if a brush is used as the filling assist member, the bristles may cover a section of the dispensing surface from 2-4 inches (5.0-10.2 cm) in length in the machine direction preferably across all or most all of the width of the dispensing surface, and lightly rest on or just above the dispensing surface, and be of a moderate flexibility. A vacuum box 125, if used as the filling assist member, is often used in conjunction with a production tool having cavities extending completely through the production tooling as shown in FIG. 5; however, even a production tool having a solid back surface 314 as seen in FIG. 3 can be an advantage since it will flatten and draw the production tooling more planar for improved filling of the cavities. The vacuum box 125 is located near the abrasive particle feeder 118 and may be located before or after the abrasive particle feeder, or encompass any portion of a web span between a pair of idler rolls 116 in the abrasive particle filling and excess removal section of the apparatus generally illustrated at 140. Alternatively, the production tool can be supported or pushed on by a shoe or a plate to assist in keeping it planar in this section of the apparatus instead or in addition to the vacuum box 125. In embodiments, where the abrasive particles are fully contained within the cavity of the production tooling such as illustrated in FIG. 11B, that is to say where the majority (e.g., 80, 90, or 95 percent) of the abrasive particles in the cavities do not extend past the dispensing surface of the production tooling, it is easier for the filling assist member to move the abrasive particles around on the dispensing surface of the production tooling without dislodging an individual crushed abrasive particle already contained within an individual cavity.

Optionally, as the production tool advances in the machine direction, the cavities 220 move to a higher elevation and can optionally reach a higher elevation than the abrasive particle feeder's outlet for dispensing the initial crushed abrasive particles onto the dispensing surf ace of the production tool. If the production tool is an endless belt, the belt can have a positive incline to advance to a higher elevation as it moves past the abrasive particle feeder 118. If the production tool is a roll, the abrasive particle feeder 118 can be positioned such that it applies the initial crushed abrasive particles to the roll before top dead center of the roll's outer circumference such as between 270 degrees to 350 degrees on the face of the roll with top dead center being 0 degrees as one progresses clockwise about the roll with the roll turning in a clockwise in operation. It is believed that applying the initial crushed abrasive particles to an inclined dispensing surface 212 of the production tool can enable better filling of the cavities. The abrasive particles can slide or tumble down the inclined dispensing surface 212 of the production tool thereby enhancing the possibility of falling into a cavity. In embodiments, where the abrasive particles are fully contained within the cavity of the production tooling as illustrated in FIG. 11B, that is to say where the majority (e.g., 80, 90, or 95 percent) of the crushed abrasive particles in the cavities do not extend past the dispensing surface of the production tooling, the incline can also assist in removing excess crushed abrasive particles from the dispensing surface of the production tooling since excess crushed abrasive particles can slide off the dispensing surface of the production tooling towards the incoming end. The incline may be between zero degrees up to an angle where the crushed abrasive particles begin to fall out of the cavities. The preferred incline will depend on the crushed abrasive particle shape and the magnitude of the force (e.g., friction or vacuum) holding the crushed abrasive particle in the cavity. In some embodiments, the positive incline is in a range of from +10 to +80 degrees, or from +10 to +60 degrees, or from +10 to +45 degrees.

Optionally, an abrasive particle removal member 121 can be provided to assist in removing the excess crushed abrasive particles from the surface of the production tooling 200 once most or all of the cavities have been filled by one or more abrasive particles. The abrasive particle removal member can be, for example, a source of air to blow the excess crushed abrasive particles off the dispensing surface of the production tooling such as an air wand, air shower, air knife, a conada effect nozzle, or a blower. A contacting device can be used as the abrasive particle removal member such as a brush, a scraper, a wiper, or a doctor blade. A vibrator, such as an ultrasonic horn, can be used as the abrasive particle removal member. Alternatively, a vacuum source such as vacuum box or vacuum roll located along a portion of the first web path after the abrasive particle feeder 118 with a production tool having cavities extending completely through the production tool as shown in FIG. 5 can be used to hold the crushed abrasive particles in the cavities. In this span or section of the first web path, the dispensing surface of the production tool can be inverted or have a large incline or decline approaching or exceeding 90 degrees to remove the excess crushed abrasive particles using the force of gravity to slide or drop them from the dispensing surface while retaining the crushed abrasive particles disposed in the cavities by vacuum until the dispensing surface is returned to an orientation to keep the crushed abrasive particles in the cavities due to the force of gravity or they are released from the cavities onto the resin-coated backing. In embodiments, where the abrasive particle is fully contained within the cavity of the production tooling such as FIG. 11B, that is to say where the majority (e.g., 80, 90, or 95 percent) of the crushed abrasive particles in the cavities do not extend past the dispensing surface of the tooling, the abrasive particle removal member 121 can slide the excess crushed abrasive particles across the dispensing surface of the production tooling and off of the production tool without disturbing the crushed abrasive particles contained within the cavities. The removed excess abrasive particles can be collected and returned to the abrasive particle feeder for reuse. The excess abrasive particles can alternatively be moved in a direction opposite to the direction of travel of the production tool past or towards the abrasive particle feeder where they may fill unoccupied cavities.

After leaving the abrasive particle filling and excess removal sections of the apparatus generally illustrated at 140, the abrasive particles in the production tool 220 travel towards the resin-coated backing 114. The elevation of the production tooling in this section is not particularly important as long as the platey crushed abrasive particles are retained in the cavities and the production tool could continue to incline, decline, or travel horizontally. Choice of the positioning is often determined by existing space within the machine if retrofitting an existing abrasive maker. An abrasive particle transfer roll 122 is provided and the production tooling 220 often wraps at least a portion of the roll's circumference. In some embodiments, the production tool wraps between 30 to 180 degrees, or between 90 to 180 degrees of the outer circumference of the abrasive particle transfer roll. The resin-coated backing 114 often also wraps at least a portion of the roll's circumference such that abrasive particles in the cavities are transferred from the cavities to the resin-coated backing as both traverse around the abrasive particle transfer roll 122 with the production tooling 220 located between the resin-coated backing and the outer surface of the abrasive particle transfer roll with the dispensing surface of the production tooling facing and generally aligned with the resin-coated first major surface of the backing. The resin-coated backing often wraps a slightly smaller portion of the abrasive particle transfer roll than the production tooling. In some embodiments, the resin-coated backing wraps between 40 to 170 degrees, or between 90 to 170 degrees of the outer circumference of the abrasive particle transfer roll. Preferably, the speed of the dispensing surface and the speed of the resin layer of the resin-coated backing are speed matched to each other within ±10 percent, ±5 percent, or ±1 percent, for example.

Figure 12A:
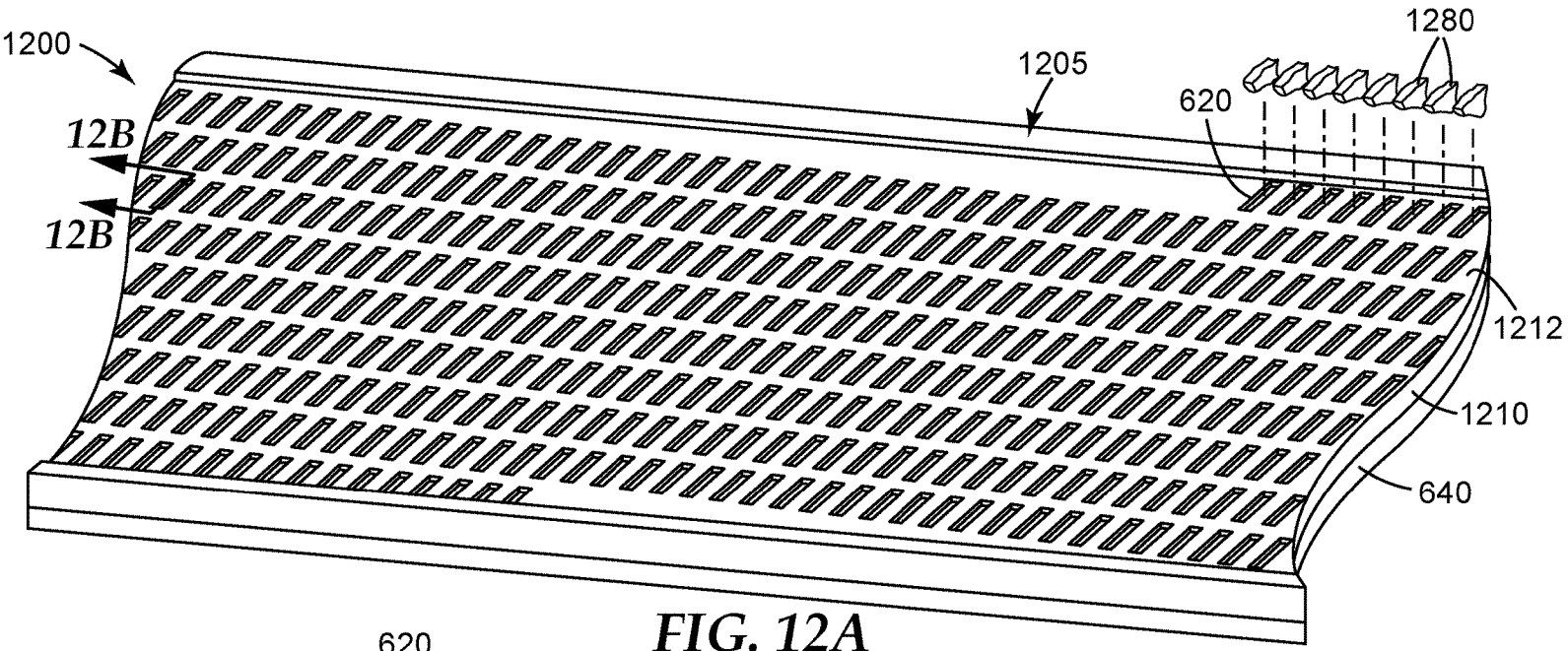
FIG. 12A is a schematic partially-exploded perspective view of an exemplary perspective view of an abrasive particle positioning system 1200 according to one exemplary embodiment of the present disclosure.

Various methods can be employed to transfer the abrasive particles from cavities of the production tool to the resin-coated backing. In no particular order the various methods are:

1. Gravity assist where the production tooling and dispensing surface is inverted for a portion of its machine direction travel and the abrasive particles fall out of the cavities under the force of gravity onto the resin-coated backing. Typically in this method, the production tooling has two lateral edge portions with standoff members 260 (FIG. 2) located on the dispensing surface 212 and that contact the resin-coated backing at two opposed edges of the backing where resin has not been applied to hold the resin layer slightly above the dispensing surface of the production tooling as both wrap the abrasive particle transfer roll. Thus, there is a gap between the dispensing surface and the top surface of the resin layer on the resin-coated backing so as to avoid transferring any resin to the dispensing surface of the production tooling. In one embodiment, the resin-coated backing has two edge strips free of resin and a resin-coated middle section while the dispensing surface can have two raised ribs extending in the longitudinal direction of the production tooling for contact with the resin free edges of the backing. In another embodiment, the abrasive particle transfer roll can have two raised ribs or rings on either end of the roll and a smaller diameter middle section with the production tooling contained within the smaller diameter middle section of the abrasive particle transfer roll as it wraps the abrasive particle transfer roll. The raised ribs or end rings on the abrasive particle transfer roll elevate the resin layer of the resin-coated backing above the dispensing surface such that there is a gap between the two surfaces. Alternatively, raised posts distributed on the production tooling surface could be used to maintain the gap between the two surfaces.
2. Pushing assist where each cavity in the production tooling has two open ends such that the abrasive particle can reside in the cavity with a portion of the abrasive particle extending past the back surface 214 of the production tooling. With push assist the production tooling no longer needs to be inverted but it still may be inverted. As the production tooling wraps the abrasive particle transfer roll, the roll's outer surface engages with the abrasive particle in each cavity and pushes the abrasive particle out of the cavity and into the resin layer on the resin-coated backing. In some embodiments, the outer surface of the abrasive particle transfer roll comprises a resilient compressible layer with hardness Shore A durometer of, for example, 20-70, applied to provide additional compliance as the abrasive particle pushes into the resin-coated backing. In another embodiment of pushing assist, the back surface of the production tooling can be covered with a resilient compressible layer as shown in FIG. 12A instead of or in addition to the resilient outer layer of the abrasive particle transfer roll.

3. Vibration assist where the abrasive particle transfer roll or production tooling is vibrated by a suitable source such as an ultrasonic device to shake the crushed abrasive particles out of the cavities and onto the resin-coated backing.
4. Pressure assist where each cavity in the production tooling has two open ends (e.g., as shown in FIG. 5C) or the back surface 514 or the entire production tooling is suitably porous and the abrasive particle transfer roll has a plurality of apertures and an internal pressurized source of air. With pressure assist the production tooling no longer needs to be inverted but it still may be inverted. The abrasive particle transfer roll can also have movable internal dividers such that the pressurized air can be supplied to a specific arc segment or circumference of the roll to blow the crushed abrasive particles out of the cavities and onto the resin-coated backing at a specific location. In some embodiments, the abrasive particle transfer roll may also be provided with an internal source of vacuum without a corresponding pressurized region or in combination with the pressurized region typically prior to the pressurized region as the abrasive particle transfer roll rotates. The vacuum source or region can have movable dividers to direct it to a specific region or arc segment of the abrasive particle transfer roll. The vacuum can suck the crushed abrasive particles firmly into the cavities as the production tooling wraps the abrasive particle transfer roll before subjecting the crushed abrasive particles to the pressurized region of the abrasive particle transfer roll. This vacuum region be used, for example, with an abrasive particle removal member to remove excess crushed abrasive particles from the dispensing surface or may be used to simply ensure the crushed abrasive particles do not leave the cavities before reaching a specific position along the outer circumference of the crushed abrasive particles transfer roll.
5. The various above listed embodiments are not limited to individual usage and they can be mixed and matched as necessary to more efficiently transfer the crushed abrasive particles from the cavities to the resin-coated backing.

The abrasive particle transfer roll 122 precisely transfers and positions each platey crushed abrasive particle onto the resin-coated backing substantially reproducing the pattern of platey crushed abrasive particles and their specific orientation as arranged in the production tooling. Thus, a coated abrasive article can be produced at speeds of, for example, 5-15 ft/min (1.5-4.6 m/min), or more where the exact position and/or radial orientation of each platey crushed abrasive particle put onto the resin-coated backing can be precisely controlled.

After separating from the abrasive particle transfer roll 122, the production tooling travels along the first web path 99 back towards the abrasive particle filling and excess removal section of the apparatus generally illustrated at 140 with the assistance of idler rolls 116 as necessary. An optional production tool cleaner 128 can be provided to remove stuck crushed abrasive particles still residing in the cavities and/or to remove make layer precursor resin 108 transferred to the dispensing surface 212. Choice of the production tool cleaner will depend on the configuration of the production tooling and could be either alone or in combination, an additional air blast, solvent or water spray, solvent or water bath, an ultrasonic horn, or an idler roll the production tooling wraps to use push assist to force the initial crushed abrasive particles out of the cavities. Thereafter the endless production tooling 200 or belt advances to the abrasive particle filling and excess removal section 140 to be filled with new initial crushed abrasive particles.

Various idler rolls 116 can be used to guide the abrasive particle coated backing 123 having a predetermined, reproducible, non-random pattern of crushed abrasive particles on the first major surface that were applied by the abrasive particle transfer roll and held onto the first major surface by the make coat resin along the second web path 132 into an oven 124 for curing the make layer precursor resin. Optionally, a second abrasive particle coater 126 can be provided to place additional particles, such as the same or another type of abrasive particle or diluents, onto the make layer precursor resin prior to the oven 124. The second abrasive particle coater 126 can be a drop coater, spray coater, or an electrostatic coater as known to those of skill in the art. Thereafter the cured backing 128 with crushed abrasive particles can enter into an optional festoon 130 along the second web path prior to further processing such as the addition of a size layer precursor, curing of the size layer precursor, and other processing steps known to those of skill in the art of making coated abrasive articles.

Figure 1B:
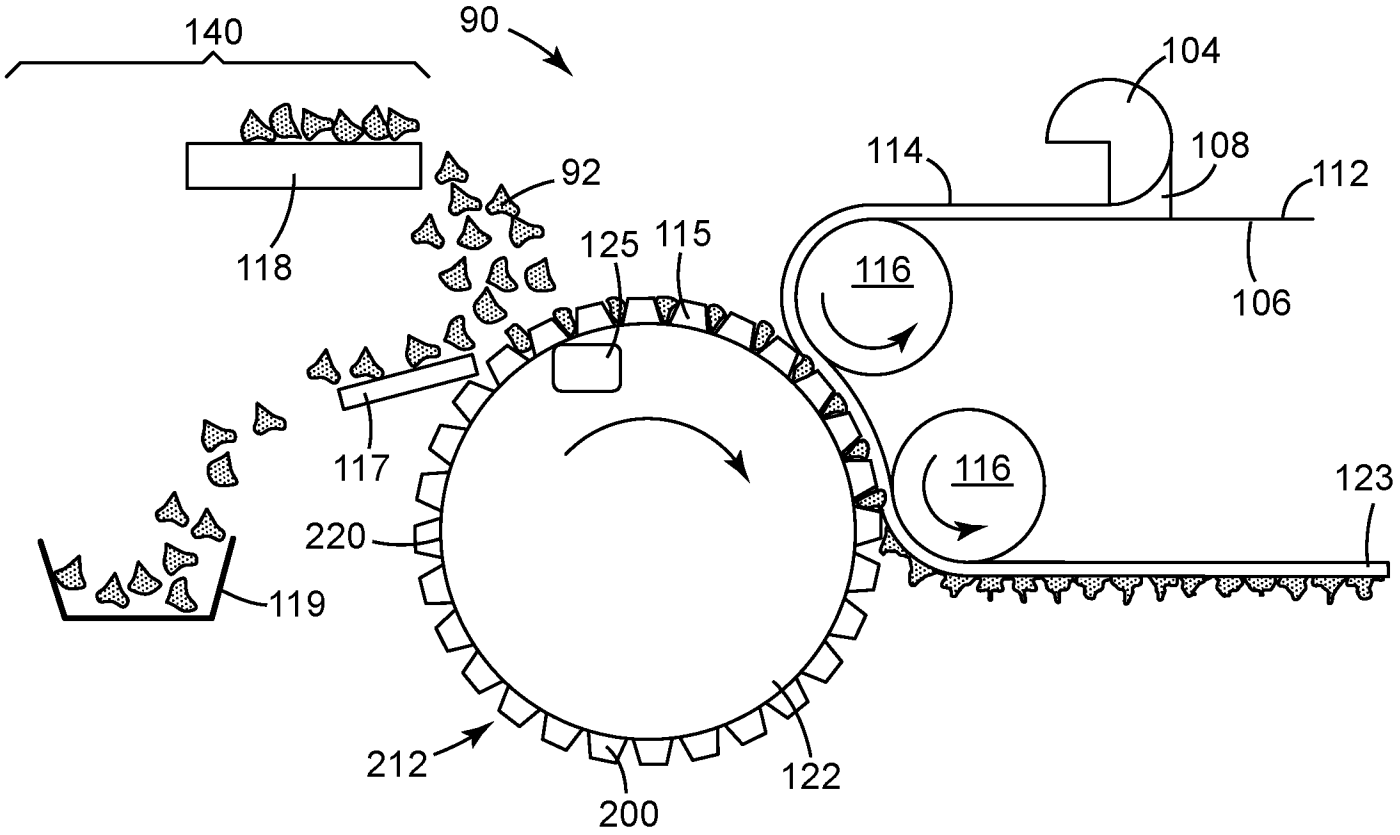
FIG. 1B is schematic view of another apparatus for making a coated abrasive article according to the present disclosure.

Referring now to FIG. 1B and FIG. 2 another apparatus 90 according to the present disclosure includes initial crushed abrasive particles 92 (which include a majority of platey crushed abrasive particles) removable disposed within shaped cavities 220 of a production tool 200. In this embodiment, the production tool can be a sleeve that fits over the abrasive particle transfer roll 122 or the cavities 220 can be machined directly into the outer circumference of the abrasive particle transfer roll 122. In FIG. 1B, the unwind and make layer precursor delivery system are not illustrated. A coater 104 applies the make layer precursor resin 108 to the first major surface 112 of the backing 106 forming the resin-coated backing 114. Thereafter the resin-coated backing 114 is guided by a pair of idler rolls 116 to wrap a portion of the abrasive particle transfer roll's outer circumference past top dead center (TDC) 115 of the abrasive particle transfer roll 122. As previously described, crushed abrasive particles 92 are applied by the abrasive particle feeder 118 to the abrasive particle transfer roll 122 prior to TDC and preferably an excess amount of crushed abrasive particles are applied. In some embodiments, the resin-coated backing 114 wraps between 20 to 180 degrees, or between 20 to 90 degrees of the outer circumference of the abrasive particle transfer roll 122.

An optional abrasive particle retaining member 117 such as a plate or chute can be placed adjacent the dispensing surface 212 of the production tooling prior to TDC to retard the freefall of the crushed abrasive particles (e.g., which may include platey and optional non-crushed abrasive particles) supplied to the dispensing surface by the abrasive particle feeder 118. The slope or incline of the abrasive particle retaining member can be adjusted to maintain a supply of crushed abrasive particles on or near the dispensing surface for deposition into the cavities while excess crushed abrasive particles slide down the inclined surface and into a catch pan 119. As with the first embodiment, an optional filling assist member 120 and an optional abrasive particle removal member 121 can also be used in this embodiment. An optional vacuum box 125 can be used internally within the abrasive particle transfer roll to pull the platey crushed abrasive particles into the cavities. Once the crushed abrasive particles are transferred to the resin-coated backing 114 and the abrasive particle coated backing 123 is guided away from the abrasive particle transfer roll 122 further processing such as described above for the first embodiment can be performed.

A coated abrasive article maker apparatus is generally illustrated at FIG. 1A. The method generally involves the steps of filling the cavities in a production tool each with a single or multiple crushed abrasive particle(s) (e.g., which may include platey and optional non-platey crushed abrasive particles), aligning a filled production tool and a resin-coated backing for transfer of the crushed abrasive particles to the resin-coated backing, and transferring the crushed abrasive particles from the cavities onto the resin-coated backing and removing the production tool from the aligned position with the resin-coated backing. Thereafter, the make layer precursor is cured, a size layer precursor is applied and cured and the coated abrasive article is converted to sheet, disk, or belt form by suitable converting equipment.

In other embodiments, a batch process can be used where a length of the production tooling can be filled with the initial crushed abrasive particles (e.g., which may include platey and optional non-platey crushed abrasive particles), aligned or positioned with a length of resin-coated backing such that the resin layer of the backing faces the dispensing surface of the production tooling and thereafter the crushed abrasive particles transferred from the cavities to the resign layer. The batch process can be practiced by hand or automated using robotic equipment.

In a specific embodiment, a method of making a patterned abrasive layer on a resin-coated backing including the flowing steps. It is not required to perform all steps or perform them in a sequential order, but they can be performed in the order listed or additional steps performed in between.

A step can be providing a production tool (FIGS. 11A and 11B) having a dispensing surface 1112 with cavities 320, each cavity having a longitudinal cavity axis 247 perpendicular to the dispensing surface and a depth D, 260, along the longitudinal cavity axis. Another step can be selecting platey crushed abrasive particles each having a length L, 270 and a width W, 271 along longitudinal particle axes greater than a thickness T, 272 (not shown) along a transverse axis substantially perpendicular to the length and width longitudinal particle axes.

In selected embodiments, the depth D, 260, of the cavities is between 0.5 times length L (0.5 L) to 2 times L (2 L), or between 1.1 times L (1.1 L) to 1.5 times L (1.5) so that the platey crushed abrasive particles disposed in the cavities reside in the production tooling beneath the dispensing surface as shown in FIG. 11B. In another embodiment, the center of mass for the platey abrasive particle resides within the cavity of the production tool when the abrasive particle is fully inserted into the cavity. If the depth of the cavities becomes too short, with the platey crushed abrasive particle's center of mass being located outside of the cavity, the platey crushed abrasive particles are not readily retained within the cavities and can jump back out as the production tool is translated through the apparatus. In a preferred embodiment, disposing the initial crushed abrasive particles beneath the surface allows for sliding excess initial crushed abrasive particles around on the dispensing surface to either move them into a cavity or to remove them from the dispensing surface.

Another step can be supplying an excess of the initial crushed abrasive particles to the dispensing surface such that more platey crushed abrasive particles are provided than the number of cavities can contain. This helps to ensure all cavities within the production tool are eventually filled with at least one abrasive particle as the initial crushed abrasive particles pile onto the dispensing surface and are moved about either due to gravity or other mechanically applied forces to translate them into a cavity. Since the bearing area and spacing of the platey crushed abrasive particles is often designed into the production tooling for the specific grinding application, it is desirable to not have too many unfilled cavities.

Another step can be filling a majority of the cavities in the dispensing surface with at least one initial (preferably platey) crushed abrasive particle disposed in each respective individual cavity such that the thickness particle axis of the crushed abrasive particles (e.g., the platey crushed abrasive particles) is substantially parallel to the transverse cavity axis. It is desirable to transfer the platey crushed abrasive particles onto the resin-coated backing such that they stand up or are erectly applied. Preferably, the particle thickness axis is parallel to the plane of the backing. The other two axes (L and W) can be further constrained by shape features of the tooling cavity such as aspect ratio and taper. Preferably, the length axis L is perpendicular to the backing plane, but this is not a requirement. Because each platey crushed abrasive particle has its own unique size and shape and is uniquely oriented by its placement in the tooling cavity, each will have its own unique orientation on the backing. Therefore the cavity shape is designed to hold the platey abrasive particles on average as erectly as possible. In various embodiments, at least 60, at least 70, at least 80, at least 90, or even at least 95 percent of the cavities in the dispensing surface contain at least one platey crushed abrasive particle (e.g., one or two). In some embodiments, gravity can be used to fill the cavities. In other embodiments, the production tool can be inverted and vacuum applied to hold the platey crushed abrasive particles or platey crushed abrasive particles in the cavities. The initial crushed abrasive particles could be applied by spray, fluidized bed (air or vibration) or electrostatic coating. Removal of excess initial crushed abrasive particles would be done by gravity as any platey crushed abrasive particles not retained would fall back down. The platey crushed abrasive particles can thereafter be transferred to the resin-coated backing by removing vacuum.

Another step can be removing a remaining fraction of the excess platey crushed abrasive particles not disposed within a cavity after the filling step from the dispensing surface. As mentioned, more platey crushed abrasive particles are supplied than cavities such that some will remain on the dispensing surface after each cavity has been filled. These excess platey crushed abrasive particles can often be blown, wiped, or otherwise removed from the dispensing surface. For example, a vacuum or other force could be applied to hold the platey crushed abrasive particles in the cavities and the dispensing surface inverted to clear it of the remaining fraction of the excess crushed abrasive particles.

Another step can be aligning the resin-coated backing with the dispensing surface with the resin layer facing the dispensing surface. Various methods can be used to align the surfaces as shown in FIGS. 1A and 1B or positioning the resin-coated backing and the production tooling by hand or robots using discrete lengths of each.

Another step can be transferring the crushed abrasive particles in the cavities to the resin-coated backing and attaching the crushed abrasive particles to the resin layer. Transferring can use gravity assist wherein the dispensing surface is positioned to allow the force of gravity to slide the crushed abrasive particles into the cavities during the filling step and the dispensing surface is inverted during the transferring step to allow the force of gravity to slide the crushed abrasive particles out of the cavities may be used. Transferring can use push assist where a contact member such as the outer circumference of the abrasive particle transfer roll, the optional compressible resilient layer attached to the back surface of the carrier layer of the production tool, or another device such as doctor blade or wiper can move the crushed abrasive particles laterally along the longitudinal cavity axis for contact with the resin layer. Transferring can use pressure assist where air blows into the cavities; especially cavities having an open opposing end from the opening in the dispensing surface to move the crushed abrasive particles laterally along the longitudinal cavity axis. Transferring can use vibration assist by vibrating the production tool to shake the crushed abrasive particles out of the cavities. These various methods may be used alone or in any combination.

Another step can be removing the production tool to expose the patterned abrasive layer on the resin-coated backing. Various removing or separating methods can be used as shown in FIGS. 1A and 1B or the production tool can be lifted by hand to separate it from the resin-coated backing. The patterned abrasive layer is an array of the crushed abrasive particles having a substantially repeatable pattern as opposed to a random distribution created by electrostatic coating or drop coating.

In any of the above embodiments, a filling assist member as previously described can move the crushed abrasive particles around on the dispensing surface after the supplying step to direct the crushed abrasive particles into the cavities. In any of the previous embodiments, the cavities can taper inward when moving along the longitudinal cavity axis from the dispensing surface. In any of the previous embodiments, the cavities can have a cavity outer perimeter surrounding the longitudinal cavity axis and the crushed abrasive particles can have an abrasive particle outer perimeter and the shape of the cavity outer perimeter is complimentary to the shape of the crushed abrasive particle outer perimeter.

Referring now to FIG. 2, exemplary production tool 200 comprises carrier member 210 having dispensing and back surfaces 212, 214. Dispensing surface 212 comprises cavities 220 that extend into carrier member 210 from cavity openings 230 at the dispensing surface 212. Optional compressible resilient layer 240 is secured to back surface 214. Cavities 220 are disposed in an array 250, which is disposed with a primary axis 252 at offset angle $\alpha$ relative to longitudinal axis 202 (corresponding to the machine direction in the case or a belt or roll) of production tool 200.

Typically, the openings of the cavities at the dispensing surface of the carrier member are rectangular; however, this is not a requirement. The length, width, and depth of the cavities in the carrier member will generally be determined at least in part by the shape and size of the platey crushed abrasive particles with which they are to be used. For example, the lengths of individual cavities may be from 1.1-1.2 times the maximum width of the platey crushed abrasive particles, the widths of individual cavities are preferably from 1.1-2.5 times the maximum thickness of the platey crushed abrasive particles, and the respective depths of the cavities are preferably 1.0 to 1.2 times the maximum length of the platey crushed abrasive particles if the platey crushed abrasive particles are to be contained within the cavities.

Alternatively, for example, the lengths of individual cavities should be less than that of the maximum width of the crushed abrasive particles, and/or the respective depths of the cavities should be less than that of the maximum length of the crushed abrasive particles if the crushed abrasive particles are to protrude from the cavities. Similarly, the width of the cavities may be selected such that it is smaller than the average length and width of the abrasive particle so that it maintains the ability to orient a majority of particles, although this is not a requirement. The width of the cavities can be selected such that a single abrasive particle fits within the majority of the cavities. Alternatively, the cavity width may be such that multiple particles, substantially aligned in a parallel fashion can occupy a single cavity.

Optional longitudinally-oriented standoff members 260 are disposed along opposite edges (e.g., using adhesive or other means) of dispensing surface 212. Variations in design of the standoff members height allow adjustment of distance between the cavity openings 230 and a substrate (e.g., a backing having a make layer precursor thereon) that is brought into contact with the production tool.

If present, the longitudinally-oriented standoff members 260 may have any height, width and/or spacing (preferably they have a height of from about 0.1 mm to about 1 mm, a width of from about 1 mm to about 50 mm, and a spacing of from about 7 to about 24 mm). Individual longitudinally-oriented standoff members may be, for example, continuous (e.g., a rib) or discontinuous (e.g., a segmented rib, or a series of posts). In the case, that the production tool comprises a web or belt, the longitudinally-oriented standoff members are typically parallel to the machine direction.

The function of offset angle $\alpha$ is to arrange the crushed abrasive particles on the ultimate coated abrasive article in a pattern that will not cause grooves in a workpiece. This is less of a concern than for shaped abrasive particles, due to the more random positioning of cutting points introduced by the wider distribution of particle sizes and shapes. The offset angle $\alpha$ may have any value from 0 to about 30 degrees, but preferably is in a range of from 1 to 5 degrees, more preferably from 1 to 3 degrees.

Suitable carrier members may be rigid or flexible, but preferably are sufficiently flexible to permit use of normal web handling devices such as rollers. Preferably, the carrier member comprises metal and/or organic polymer. Such organic polymers are preferably moldable, have low cost, and are reasonably durable when used in the abrasive particle deposition process of the present disclosure. Examples of organic polymers, which may be thermosetting and/or thermoplastic, that may be suitable for fabricating the carrier member include: polypropylene, polyethylene, vulcanized rubber, polycarbonates, polyamides, acrylonitrile-butadiene-styrene plastic (ABS), polyethylene terephthalate (PET), polybutylene terephthalate (PET), polyimides, polyetheretherketone (PEEK), polyetherketone (PEK), and polyoxymethylene plastic (POM, acetal), poly(ether sulfone), poly(methyl methacrylate), polyurethanes, polyvinyl chloride, and combinations thereof.

The production tool can be in the form of, for example, an endless belt (e.g., endless belt 200 shown in FIG. 1A), a sheet, a continuous sheet or web, a coating roll, a sleeve mounted on a coating roll, or die. If the production tool is in the form of a belt, sheet, web, or sleeve, it will have a contacting surface and a non-contacting surface. If the production tool is in the form of a roll, it will have a contacting surface only. The topography of the abrasive article formed by the method will have the inverse of the pattern of the contacting surface of the production tool. The pattern of the contacting surface of the production tool will generally be characterized by a plurality of cavities or recesses. The opening of these cavities can have any shape, regular or irregular, such as, for example, a rectangle, semi-circle, circle, triangle, square, hexagon, or octagon. The walls of the cavities can be vertical or tapered. The pattern formed by the cavities can be arranged according to a specified plan or can be random. Desirably, the cavities can butt up against one another.

The carrier member can be made, for example, according to the following procedure. A master tool is first provided. The master tool is typically made from metal, e.g., nickel. The master tool can be fabricated by any conventional technique, such as, for example, engraving, hobbing, knurling, electroforming, diamond turning, or laser machining. If a pattern is desired on the surface of the production tool, the master tool should have the inverse of the pattern for the production tool on the surface thereof. The thermoplastic material can be embossed with the master tool to form the pattern. Embossing can be conducted while the thermoplastic material is in a flowable state. After being embossed, the thermoplastic material can be cooled to bring about solidification.

The carrier member may also be formed by embossing a pattern into an already formed polymer film softened by heating. In this case, the film thickness may be less than the cavity depth. This is advantageous in improving the flexibility of carriers having deep cavities.

The carrier member can also be made of a cured thermosetting resin. A production tool made of thermosetting material can be made according to the following procedure. An uncured thermosetting resin is applied to a master tool of the type described previously. While the uncured resin is on the surface of the master tool, it can be cured or polymerized by heating such that it will set to have the inverse shape of the pattern of the surface of the master tool. Then, the cured thermosetting resin is removed from the surface of the master tool. The production tool can be made of a cured radiation curable resin, such as, for example acrylated urethane oligomers. Radiation cured production tools are made in the same manner as production tools made of thermosetting resin, with the exception that curing is conducted by means of exposure to radiation (e.g., ultraviolet radiation).

The carrier member may have any thickness as long as it has sufficient depth to accommodate the crushed abrasive particles and sufficient flexibility and durability for use in manufacturing processes. If the carrier member comprises an endless belt, then carrier member thicknesses of from about 0.5 to about 10 millimeters are typically useful; however, this is not a requirement.

The cavities may have any shape, and are typically selected depending on the specific application. Preferably, at least a portion (and more preferably a majority, or even all) of the cavities are shaped (i.e., individually intentionally engineered to have a specific shape and size), and more preferably are precisely-shaped. In some embodiments, the cavities have smooth walls and sharp angles formed by a molding process and having an inverse surface topography to that of a master tool (e.g., a diamond turned metal master tool roll) in contact with which it was formed. The cavities may be closed (i.e., having a closed bottom).

Preferably, at least some of the sidewalls taper inwardly from their respective cavity opening at the dispensing surface of the carrier member with increasing cavity depth, or the cavity opening at the back surface. More preferably, all of the sidewalls taper inwardly from the opening at the dispensing surface of the carrier member with increasing cavity depth (i.e., with increasing distance from the dispensing surface).

In some embodiments, at least some of the cavities comprise first, second, third, and fourth sidewalls. In such embodiments, the first, second, third, and fourth side walls may be consecutive and contiguous.

In embodiments in which the cavities have no bottom surface but do not extend through the carrier member to the back surface, the first and third walls may intersect at a line, while the second and fourth sidewalls do not contact each other.

Figure 3A:
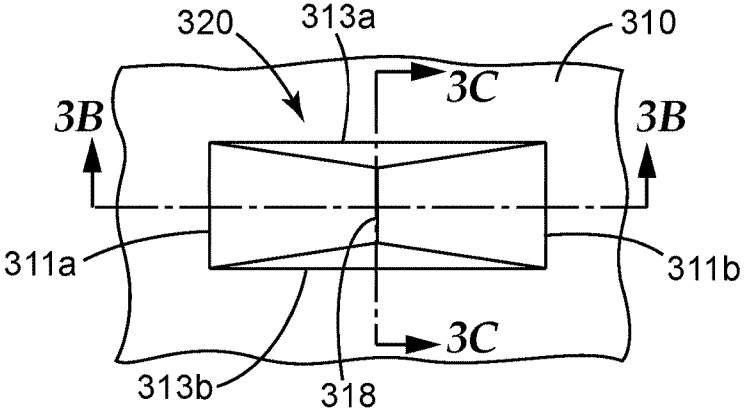
FIG. 3A is an enlarged schematic top view of an exemplary cavity 320 design suitable for use as cavities 220 in production tool 200.
Figure 3C:
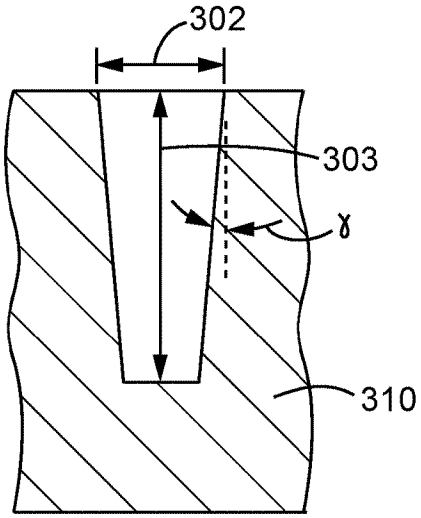
FIG. 3C is a cross-sectional view of FIG. 3A taken along plane 3C-3C.
Figure 3B:
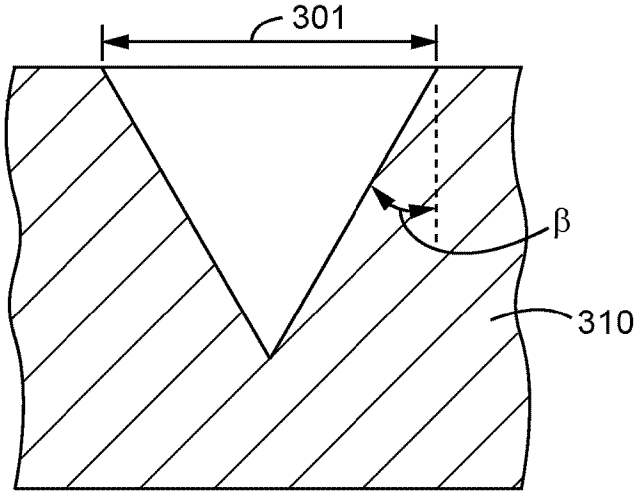
FIG. 3B is cross-sectional view of FIG. 3A taken along plane 3B-3B.

One embodiment of a cavity of this type is shown in FIGS. 3A-3C. Referring now to FIGS. 3A-3C, exemplary cavity 320 in carrier member 310 has length 301 and width 302 (see FIG. 3A), and depth 303 (see FIG. 3B). Cavity 320 comprises four sidewalls 311*a*, 311*b*, 313*a*, 313*b*. Sidewalls 311*a*, 311*b* extend from openings 330 at dispensing surface 312 of carrier member 310 and taper inward at a taper angle β with increasing depth until they meet at line 318 (see FIG. 3B). Likewise, sidewalls 313*a*, 313*b* taper inwardly at a taper angle γ with increasing depth until they contact line 318 (see FIGS. 3A and 3C).

Taper angles β and γ will typically depend on the specific crushed abrasive particles selected for use with the production tool, preferably corresponding to the shape of the platey crushed abrasive particles that are included in the crushed abrasive particles. The cavity taper can contribute to the orientation of the particle along the length axis and orient sharp points toward the cutting interface. In this embodiment, taper angle β may have any angle greater than 0 and less than 90 degrees. In some embodiments, taper angle β has a value in the range of 40 to 80 degrees, preferably 50 to 70 degrees, and more preferably 55 to 65 degrees. Taper angle γ will likewise typically be selected. In this embodiment, taper angle γ may have any angle in the range of from 0 and to 30 degrees. In some embodiments, taper angle γ has a value in the range of 5 to 20 degrees, preferably 5 to 15 degrees, and more preferably 8 to 12 degrees.

In some embodiments, the cavities are open at both the dispensing and the back surfaces. In some of these embodiments, the first and third sidewalls do not contact each other and the second and fourth sidewalls do not contact each other.

Figure 4A:
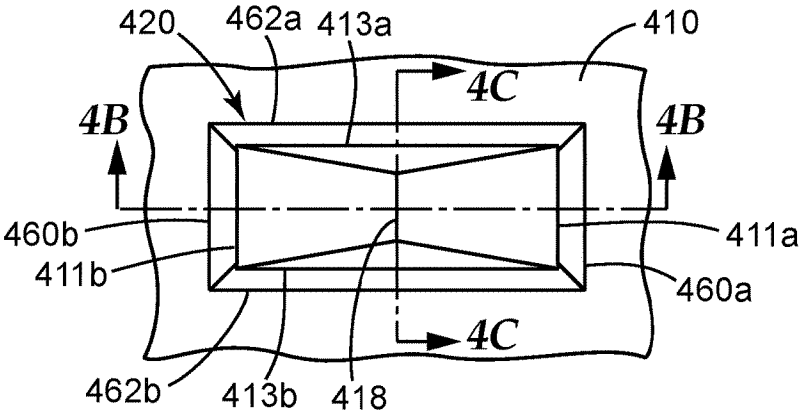
FIG. 4A is an enlarged schematic top view of an exemplary cavity 420 design suitable for use as cavities 220 in production tool 200.
Figure 4C:
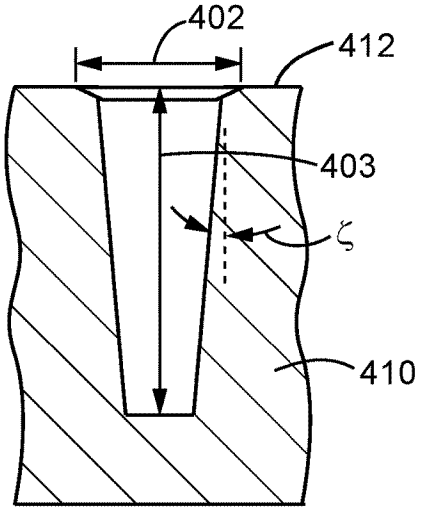
FIG. 4C is a schematic cross-sectional view of FIG. 4A taken along plane 4C-4C.
Figure 4B:
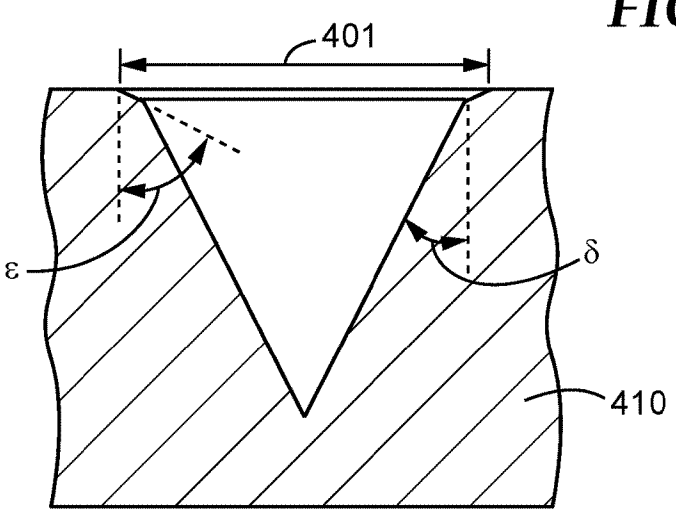
FIG. 4B is a schematic cross-sectional view of FIG. 4A taken along plane 4B-4B.

FIGS. 4A-4B show an alternative cavity 420 of similar type. Referring now to FIGS. 4A-4C, exemplary cavity 420 in carrier member 410 has length 401 and width 402 (see FIG. 4A), and depth 403 (see FIG. 4B). Cavity 420 comprises four chamfers (460*a*, 460*b*, 462*a*, 462*b*) that contact dispensing surface 412 of carrier member 410 and four respective sidewalls 411*a*, 411*b*, 413*a*, 413*b*. Chamfers 460*a*, 460*b*, 462*a*, 462*b* each taper inward at a taper angle of δ (see FIG. 4B) and help guide platey crushed abrasive particles into cavity 420. Sidewalls 411*a*, 411*b* extend from chamfers (460*a*, 460*b*) and taper inward at a taper angle ε with increasing depth until they meet at line 418 (see FIG. 4B). Sidewalls 413*a*, 413*b* likewise taper inwardly at a taper angle ζ with increasing depth until they contact line 418 (see FIGS. 4B and 4C).

Taper angle δ will typically depend on the specific platey crushed abrasive particles selected for use with the production tool. In this embodiment, taper angle δ may have any angle greater than 0 and less than 90 degrees. Preferably, taper angle δ has a value in the range of 20 to 80 degrees, preferably 30 to 60 degrees, and more preferably 35 to 55 degrees Taper angle ε will typically depend on the specific platey crushed abrasive particles selected for use with the production tool. In this embodiment, taper angle ε may have any angle greater than 0 and less than 90 degrees. In some embodiments, taper angle ε has a value in the range of 40 to 80 degrees, preferably 50 to 70 degrees, and more preferably 55 to 65 degrees.

Taper angle ζ will likewise typically depend on the specific platey crushed abrasive particles selected for use with the production tool. In this embodiment, taper angle ζ may have any angle in the range of from 0 and to 30 degrees. In some embodiments, taper angle ζ has a value in the range of 5 to 25 degrees, preferably 5 to 20 degrees, and more preferably 10 to 20 degrees.

The cavities may have a second opening at the back surface. In such cases, the second opening is preferably smaller than the first opening such that the platey crushed abrasive particles do not pass completely through both openings (i.e., the second opening is small enough to prevent passage of the platey crushed abrasive particles through the carrier member).

Figure 5A:
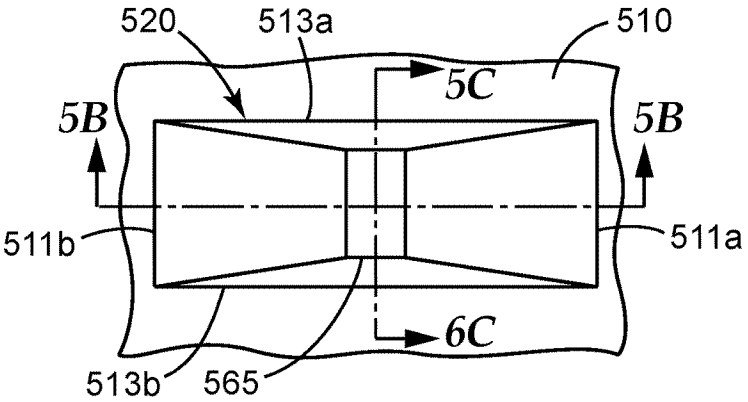
FIG. 5A is an enlarged schematic top view of an exemplary cavity 520 design suitable for use as cavities 220 in production tool 200.
Figure 5C:
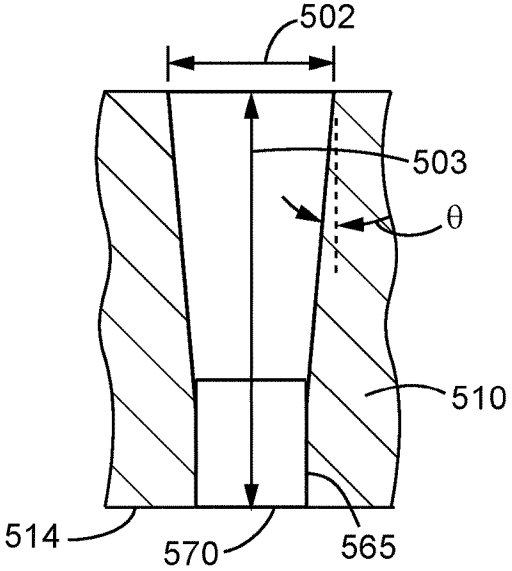
FIG. 5C is a schematic cross-sectional view of exemplary cavity 520 shown in FIG. 5A taken along plane 5C-5C.
Figure 5B:
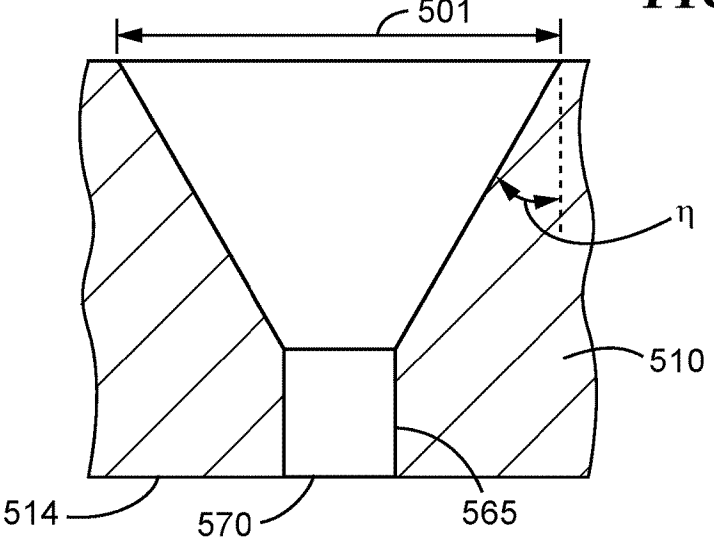
FIG. 5B is a schematic cross-sectional view of exemplary cavity 520 shown in FIG. 5A taken along plane 5B-5B.

One exemplary embodiment of a cavity of this type is shown in FIGS. 5A-5C. Referring now to FIGS. 5A-5C, exemplary cavity 520 in carrier member 510 has length 501 and width 502 (see FIG. 5A), and depth 503 (see FIG. 5B). Cavity 520 comprises four sidewalls 511*a*, 511*b*, 513*a*, 513*b*. Sidewalls 511*a*, 511*b* extend from first opening 530 at dispensing surface 512 of carrier member 510 and taper inward at a taper angle η with increasing depth until they contact conduit 565 which extends to second opening 570 at back surface 514 of carrier member 510 (see FIG. 5B). Likewise, sidewalls 513*a*, 513*b* taper inwardly at a taper angle θ with increasing depth until they contact second opening 570 (see FIG. 5C). Conduit 565 is shown as having constant cross-section; however, this is not a requirement.

Taper angles η and θ will typically depend on the specific platey crushed abrasive particles selected for use with the production tool, preferably corresponding to the shape of the platey crushed abrasive particles. In this embodiment, taper angle η may have any angle greater than 0 and less than 90 degrees. In some embodiments, taper angle η has a value in the range of 40 to 80 degrees, preferably 50 to 70 degrees, and more preferably 55 to 65 degrees.

In this embodiment, taper angle θ may have any angle in the range of from 0 and to 30 degrees. In some embodiments, taper angle θ has a value in the range of 5 to 25 degrees, preferably 5 to 20 degrees, and more preferably 10 to 20 degrees.

Figure 6A:
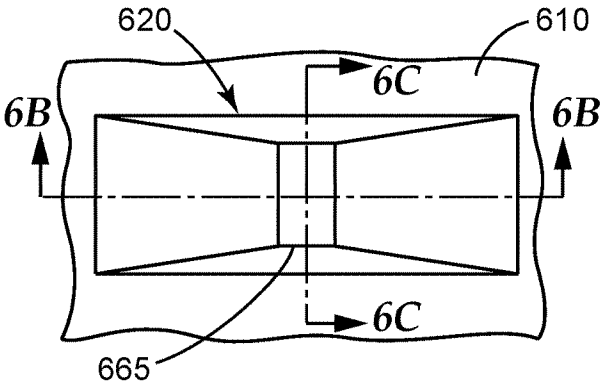
FIG. 6A is an enlarged schematic top view of an exemplary cavity 620 design suitable for use as cavities 220 in production tool 200.
Figure 6C:
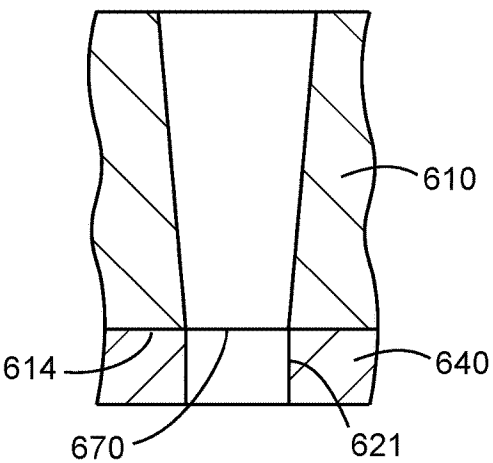
FIG. 6C is a schematic cross-sectional view of FIG. 6A taken along plane 6C-6C.
Figure 6B:
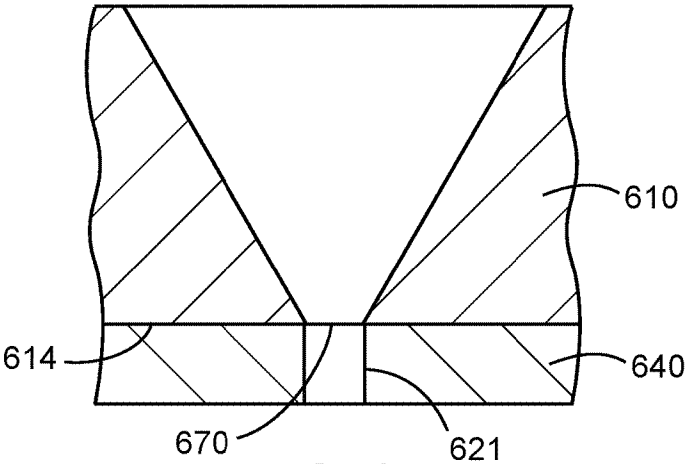
FIG. 6B is a schematic cross-sectional view of FIG. 6A taken along plane 6B-6B.

Another embodiment of a cavity having openings at the dispensing and back surfaces of the carrier member is shown in FIGS. 6A-6C. Referring now to FIGS. 6A-6C, carrier member 610 includes cavities 620 in carrier member 610 aligned with compressible conduits 621 in resilient compressible layer 640. Compressible conduits 621 extend from second opening 670 at back surface 614 of carrier member 610 through resilient compressible layer 640. While a compressible conduit is shown, it will be recognized that closed compressible cavity configurations may also be used.

The cavities are positioned according to at least one of: a predetermined pattern such as, for example, an aligned pattern (e.g., an array), a circular pattern, an irregular but partially aligned pattern, or a pseudo-random pattern.

Preferably, the lengths and/or widths of the cavities narrow with increasing cavity depth, being largest at the cavity openings at the dispensing surface. The cavity dimensions and/or shapes are preferably chosen for use with a specific shape and/or size of abrasive particle. The cavities may comprise a combination of different shapes and/or sizes, for example. The cavity dimensions should be sufficient to accommodate and orient the individual platey crushed abrasive particles at least partially within the cavities. In some embodiments, a majority or all of the platey crushed abrasive particles are retained in the cavities such that less than about 20 percent (more preferably less than 10 percent, or even less than 5 percent) of their length extends past the openings of the cavities in which they reside. In some embodiments, a majority or all of the platey crushed abrasive particles fully reside within (i.e., are completely retained within) the cavities and do not extend past their respective cavity openings at the dispensing surface of the carrier member.

The cavities comprise at least one sidewall and may comprise at least one bottom surface; however, preferably the entire cavity shape is defined by the sidewalls and any openings at the dispensing and back surfaces. In some preferred embodiments, the cavities have at least 3, at least 4, at least 5, at least 6, at least 7, at least 8 sidewalls The sidewalls are preferably smooth, although this is not a requirement. The sidewalls may be planar, curviplanar (e.g., concave or convex), conical, or frustoconical, for example.

In some embodiments, at least some of the cavities comprise first, second, third, and fourth sidewalls. In such embodiments, the first, second, third, and fourth side walls may be consecutive and contiguous.

In embodiments in which the cavities have no bottom surface but do not extend through the carrier member to the back surface, the first and third walls may intersect at a line, while the second and fourth sidewalls do not contact each other.

In some embodiments, the cavities are open at both the first and the back surfaces. In some of these embodiments, the first and third sidewalls do not contact each other and the second and fourth sidewalls do not contact each other.

Preferably, at least some of the sidewalls taper inwardly from their respective cavity opening at the dispensing surface of the carrier member with increasing cavity depth, or the cavity opening at the back surface. More preferably, all of the sidewalls taper inwardly from the opening at the dispensing surface of the carrier member with increasing cavity depth (i.e., with increasing distance from the dispensing surface).

In some embodiments, at least one, at least two, at least 3, or even at least 4 of the sidewalls are convex.

In some embodiments, at least some of the cavities may independently comprise one or more chamfers disposed between the dispensing surface and any or all of the sidewalls. The chamfers may facilitate disposition of the platey crushed abrasive particles within the cavities.

To avoid buildup of the make layer precursor resin on the dispensing surface of the carrier member, at least two longitudinally-oriented (i.e., oriented substantially parallel to the machine direction of the carrier member/production tool in use) raised standoff members are preferably affixed to or integrally formed with the carrier. Preferably, at least two of the standoff members are disposed adjacent to the side edges along the length of the production tool. Examples of suitable standoff members that can be integrally formed with the carrier member include posts and ribs (continuous or segmented). Longitudinal orientation of the standoff members may be achieved by orientation of individual raised standoff members such as ribs or tapes, or by patterns of low aspect raised stand of members such as, for example, an isolated row or other pattern of posts or other raised features.

Figure 7:
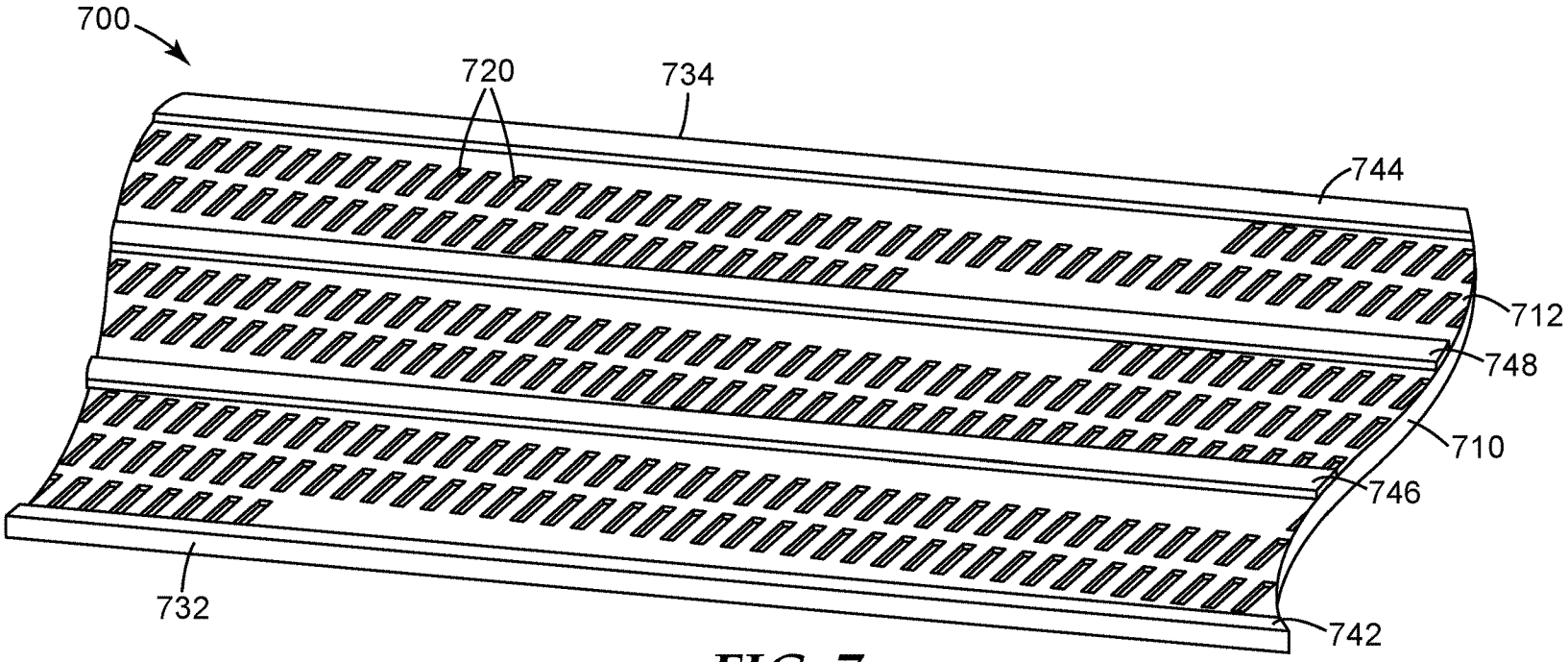
FIG. 7 is a schematic perspective view of an exemplary production tool 700 according to one exemplary embodiment of the present disclosure.

Referring now to FIG. 7, one exemplary production tool 700, an endless belt, comprises carrier member 710 with cavities 720. Longitudinally-oriented raised standoff members 742, 744 are composed of continuous ribs integrally formed along and adjacent to side edges 732, 734 of carrier member 700 thereby providing an offset between dispensing surface 712 of carrier member 710 and a make layer precursor coated backing during the transfer of the initial crushed abrasive particles. Optional longitudinally-oriented raised standoff members 746, 748 are composed of ribs integrally formed at intervals across the width of carrier member 710.

Figure 8:
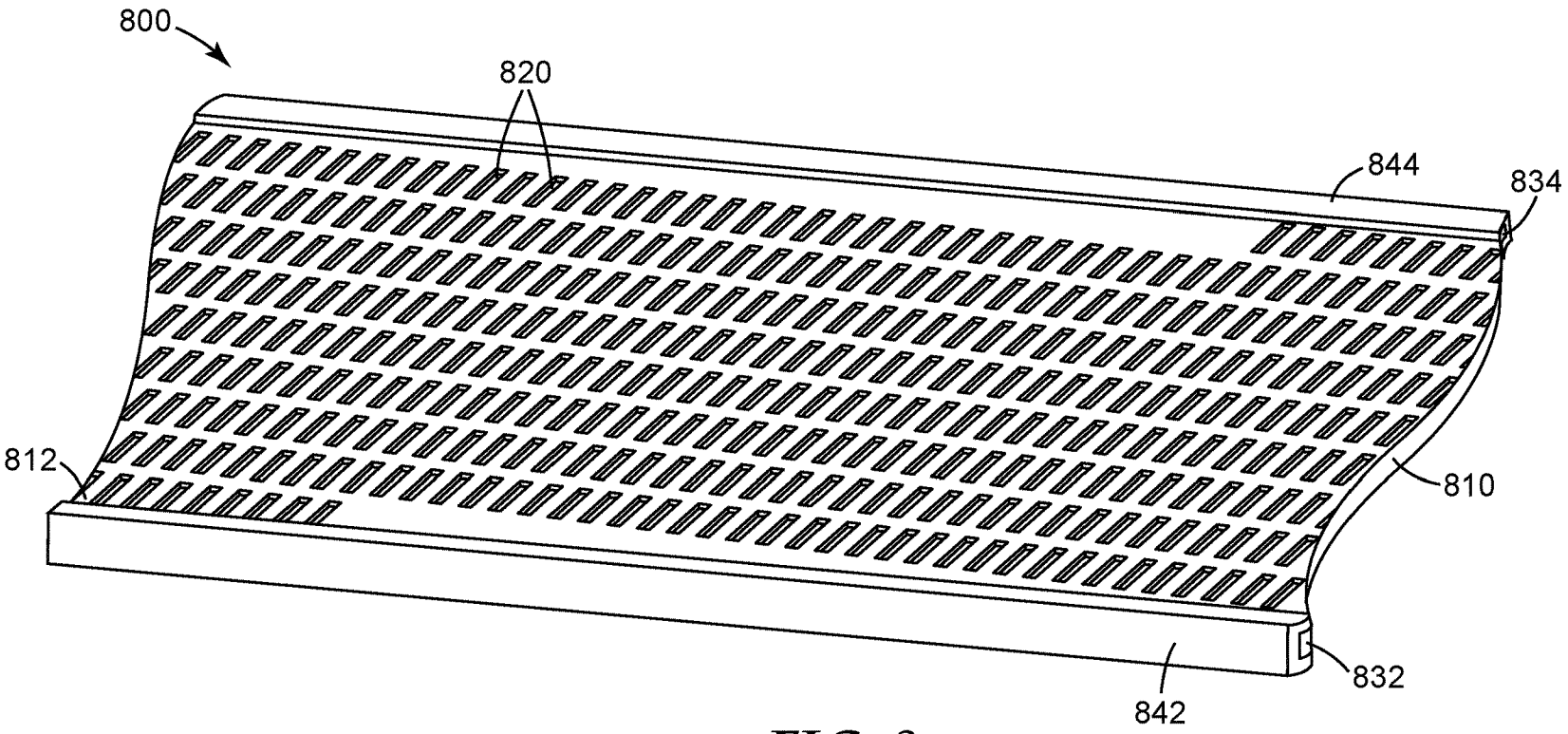
FIG. 8 is a schematic perspective view of an exemplary production tool 800 according to one exemplary embodiment of the present disclosure.

Alternatively, or in addition, the standoff members may be otherwise affixed to the carrier member; for example, using adhesive or a mechanical fastener. One example of a preferred standoff member comprises adhesive-backed tape. Tape may be applied to just the dispensing surface of the carrier member, or it may be folded over the side edges and adhered to the back surface of the carrier member, for example. Referring now to FIG. 8, one exemplary production tool 800, an endless belt, comprises carrier member 810 with cavities 820. Tapes 842, 844 are applied around side edges 832, 834 of carrier member 800 thereby providing an offset between the dispensing surface 812 of carrier member 810 and a make layer precursor coated backing during the transfer of crushed abrasive particles.

Figure 9:
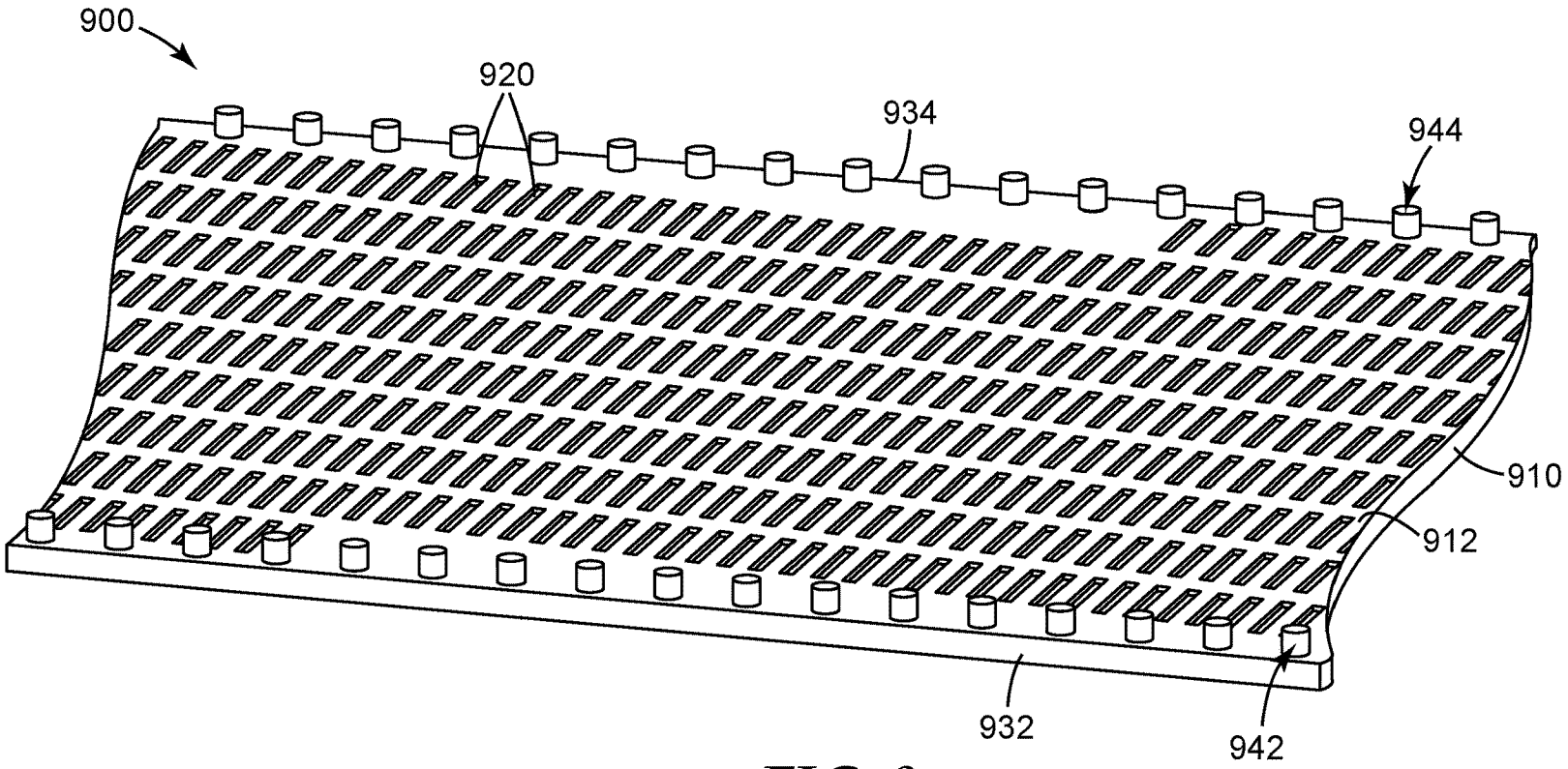
FIG. 9 is a schematic perspective view of an exemplary production tool 900 according to one exemplary embodiment of the present disclosure.

Alternatively, or in addition, multiple standoff members such as, for example, rows of raised posts collectively longitudinally-oriented by positioning at intervals along and adjacent to side edges of the carrier member. Referring now to FIG. 9, one exemplary production tool 900, an endless belt, comprises carrier member 910 with cavities 920. Rows of raised posts 942, 944 are integrally formed in carrier member 910 adjacent side edges 932, 934 of carrier member 910 thereby providing an offset between dispensing surface 912 of carrier member 910 and a make layer precursor coated backing during the transfer of crushed abrasive particles.

Design and fabrication of carrier members, and of master tooling used in their manufacture, can be found in, for example, U.S. Pat. No. 5,152,917 (Pieper et al.); U.S. Pat. No. 5,435,816 (Spurgeon et al.); U.S. Pat. No. 5,672,097 (Hoopman et al.); U.S. Pat. No. 5,946,991 (Hoopman et al.); U.S. Pat. No. 5,975,987 (Hoopman et al.); and U.S. Pat. No. 6,129,540 (Hoopman et al.).

To form an abrasive particle positioning system, crushed abrasive particles are introduced into at least some cavities of a carrier member as described herein.

The crushed abrasive particles can be disposed within the cavities of the carrier member using any suitable technique. Examples include dropping the crushed abrasive particles onto the carrier member while it is oriented with the dispensing surface facing upward, and then agitating the particles sufficiently to cause them to fall into the cavities. Examples of suitable agitation methods may include, brushing, blowing, vibrating, applying a vacuum (for carrier members having cavities with openings at the back surface), and combinations thereof.

In typical use, crushed abrasive particles (including the platey crushed abrasive particles) are removably disposed within at least a portion, preferably at least 30, at least 40, at least 50, at least 60, at least 70, at least 80, at least 90 percent, or even 100 percent of the cavities in the production tool. Preferably, crushed abrasive particles are removably and completely disposed within at least some of the cavities, more preferably the crushed abrasive particles are removably and completely disposed within at least 80 percent of the cavities. In some embodiments, the crushed abrasive particles protrude from the cavities or reside completely within them, or a combination thereof.

Figure 10A:
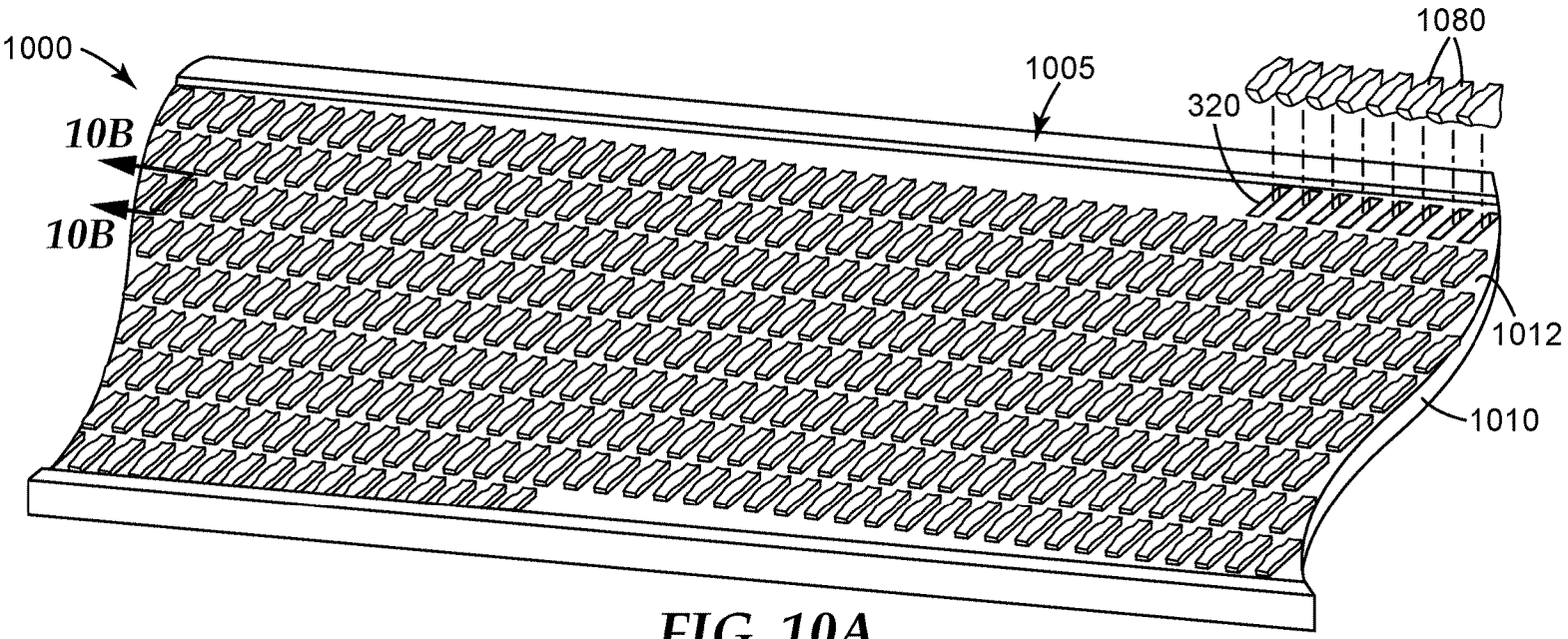
FIG. 10A is a schematic partially-exploded perspective view of an exemplary perspective view of an abrasive particle positioning system 1000 according to one exemplary embodiment of the present disclosure.
Figure 10B:
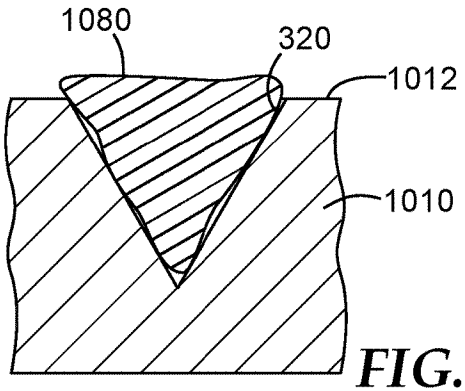
FIG. 10B is a schematic cross-sectional side view of abrasive particle positioning system 1000 taken along plane 10B-10B.

For example, referring now to FIGS. 10A and 10B, abrasive particle positioning system 1000 comprises crushed abrasive particles 1080 and production tool 1005. Crushed abrasive particles 1080 are disposed partially within cavities 320 (shown in FIGS. 3A-3C) in dispensing surface 1012 of carrier member 1010 of production tool 1005. In this embodiment, platey crushed abrasive particles 1080 protrude from respective cavities 320.

Figure 11A:
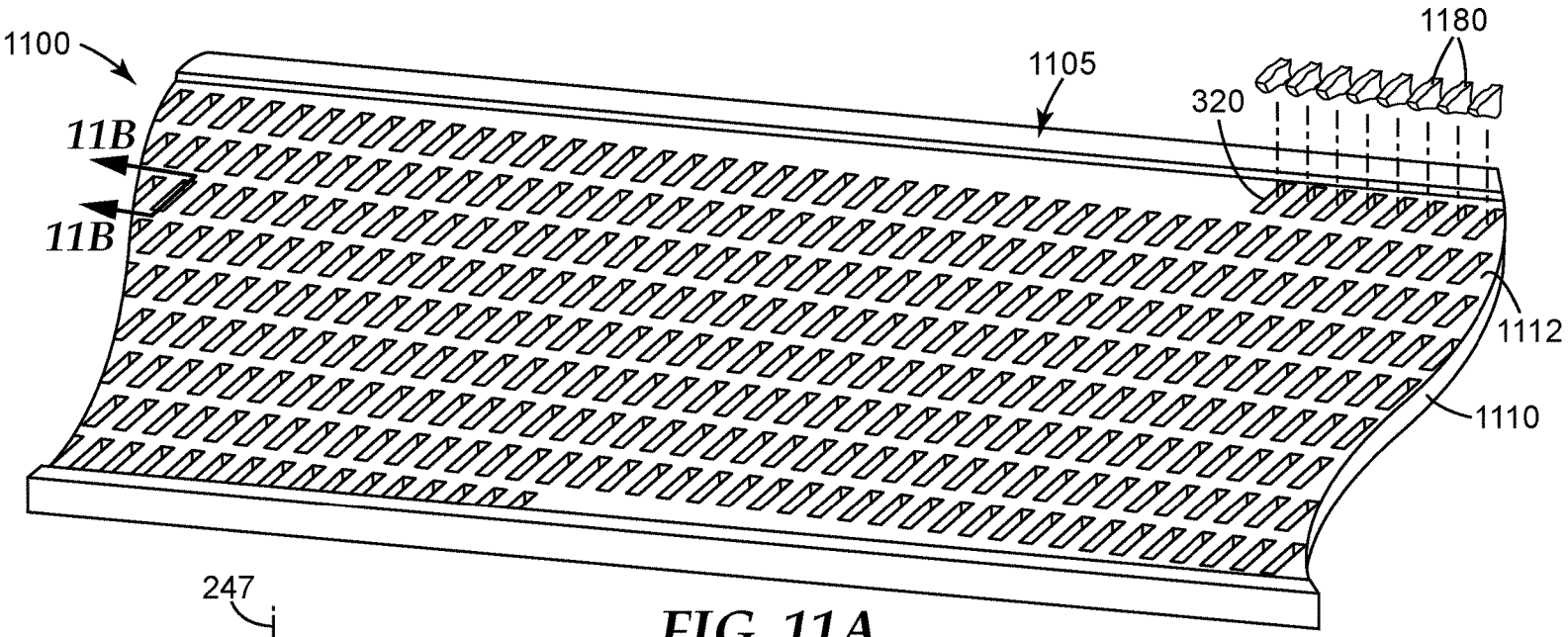
FIG. 11A is a schematic partially-exploded perspective view of an exemplary perspective view of an abrasive particle positioning system 1100 according to one exemplary embodiment of the present disclosure.
Figure 11B:
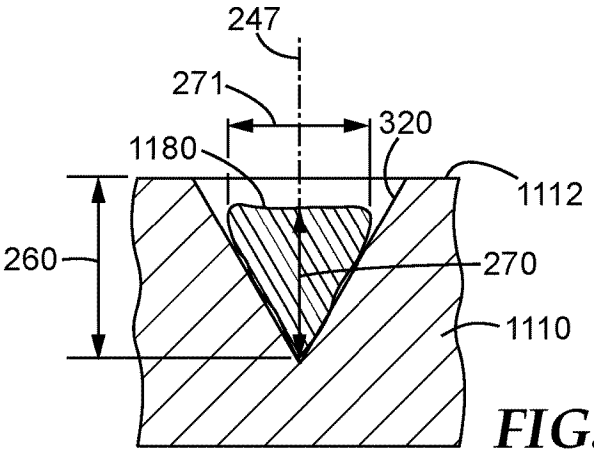
FIG. 11B is a schematic cross-sectional side view of abrasive particle positioning system 1100 taken along plane 11B-11B.

Referring now to FIGS. 11A and 11B, abrasive particle positioning system 1100 comprises crushed abrasive particles 1180 and production tool 1105. Platey crushed abrasive particles 1180 are fully disposed within cavities 320 (shown in FIGS. 3A-3C) in dispensing surface 1112 of carrier member 1110 of production tool 1105.

Figure 12B:
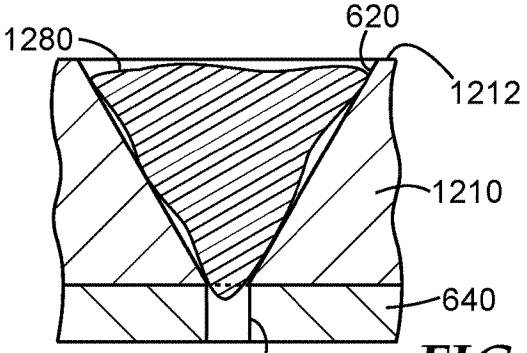
FIG. 12B is a schematic cross-sectional side view of abrasive particle positioning system 1200 taken along plane 12B-12B.

Referring now to FIGS. 12A and 12B, abrasive particle positioning system 1200 comprises crushed abrasive particles 1280 and production tool 1205. Platey crushed abrasive particles 1280 are disposed within cavities 620 (shown in FIGS. 6A-6C) in dispensing surface 1212 of carrier member 1210 of production tool 1205. In this embodiment, crushed abrasive particles 1280 are disposed within respective cavities 620, with tips protruding into compressible conduits 621. Compression of the resilient compressible layer 640 (e.g., against a roller) urges the crushed abrasive particles from the cavities.

As discussed above, a resilient compressible layer may be secured to the back surface of the carrier member, regardless of whether the cavities extend through to the back surface. This may facilitate web handling and/or abrasive particle removal from the cavities. For example, in embodiments wherein the resilient compressible layer comprises shaped recesses aligned in registration with the respective second opening of each one of at least a portion of the cavities crushed abrasive particles in the cavities that extend into the shaped recesses may be mechanically urged out of the cavities by pressure applied against the resilient compressible layer. This may occur, for example, by compression at a nip roll where the abrasive particle positioning system contacts a make layer precursor on a backing during manufacture of coated abrasive articles. If present, the resilient compressible layer may have any thickness, with the specific choice of crushed abrasive particles and equipment condition determining the selection of thickness, composition, and/or durometer. If the resilient compressible layer comprises an endless belt, then resilient compressible layer thicknesses of from about 1 to about 25 millimeters are typically useful, but this is not a requirement.

Exemplary materials suitable for the resilient compressible layers include elastic foams (e.g., polyurethane foams), rubbers, silicones, and combinations thereof.

The initial crushed abrasive particles, and preferably any additional crushed abrasive particles that may be present (e.g. crushed abrasive filler particles), should have sufficient hardness and surface roughness to function as abrasive particles in abrading processes. Preferably, the crushed abrasive particles have a Mohs hardness of at least 4, at least 5, at least 6, at least 7, or even at least 8.

The weight percentage of the initial crushed abrasive particles to the total weight of crushed abrasive particles (e.g., initial crushed abrasive particles plus optional crushed filler particles) may be at least 35 percent, at least 40 percent, at least 45 percent, at least 50 percent, at least 55 percent, at least 60 percent, at least 65 percent, at least 70 percent, at least 75 percent, at least 80 percent, at least 85 percent, at least 90 percent, at least 95 percent, or even 100 percent.

Likewise, if present, the weight percentage of the crushed filler particles to the total weight crushed abrasive particles (e.g., initial crushed abrasive particles plus crushed filler particles) may be less than 35, less than 30 percent, less than 25 percent, less than 20 percent, less than 15 percent, less than 10 percent, less than 5 percent, for example.

The initial crushed abrasive particles and the optional filler abrasive particles may have the same or different specified nominal size grade (preferably different), and they may have the same or different composition (preferably different), but they may not have the same composition and specified nominal size grade. The initial crushed abrasive particles may have a monomodal or polymodal (e.g., bimodal, trimodal) distribution. The initial crushed abrasive particles may be applied the make layer precursor in a single step or in several, preferably consecutive, steps, for example.

In some embodiments, the initial crushed abrasive particles may comprise abrasive particles of different material compositions, although they are preferably the all of the same composition.

Crushed abrasive particles (including crushed abrasive particles containing a majority of platey crushed abrasive particles) can be obtained from commercial sources, by known methods, and/or by shape sorting crushed abrasive particles; for example, using a shape-sorting table as is known in the art.

Examples of suitable crushed abrasive particles (e.g. for the initial crushed abrasive particles and the optional crushed filler particles) include crushed abrasive particles comprising fused aluminum oxide, heat-treated aluminum oxide, white fused aluminum oxide, ceramic aluminum oxide materials such as those commercially available as 3M CERAMIC ABRASIVE GRAIN from 3M Company, St. Paul, Minn., brown aluminum oxide, blue aluminum oxide, silicon carbide (including green silicon carbide), titanium diboride, boron carbide, tungsten carbide, garnet, titanium carbide, diamond, cubic boron nitride, garnet, fused alumina zirconia, iron oxide, chromia, zirconia, titania, tin oxide, quartz, feldspar, flint, emery, sol-gel-derived ceramic (e.g., alpha alumina), and combinations thereof. Further examples include crushed abrasive composites of abrasive particles (which may be platey or not) in a binder matrix, such as those described in U.S. Pat. No. 5,152,917 (Pieper et al.). Many such abrasive particles, agglomerates, and composites are known in the art.

Examples of sol-gel-derived abrasive particles from which crushed abrasive particles can be isolated, and methods for their preparation can be found, in U.S. Pat. No. 4,314,827 (Leitheiser et al.); U.S. Pat. No. 4,623,364 (Cottringer et al.); U.S. Pat. No. 4,744,802 (Schwabel), U.S. Pat. No. 4,770,671 (Monroe et al.); and U.S. Pat. No. 4,881,951 (Monroe et al.). It is also contemplated that the crushed abrasive particles could comprise abrasive agglomerates such, for example, as those described in U.S. Pat. No. 4,652,275 (Bloecher et al.) or U.S. Pat. No. 4,799,939 (Bloecher et al.). In some embodiments, the crushed abrasive particles may be surface-treated with a coupling agent (e.g., an organosilane coupling agent) or other physical treatment (e.g., iron oxide or titanium oxide) to enhance adhesion of the crushed abrasive particles to the binder. The crushed abrasive particles may be treated before combining them with the binder, or they may be surface treated in situ by including a coupling agent to the binder.

Preferably, the crushed abrasive particles comprise ceramic crushed abrasive particles such as, for example, sol-gel-derived polycrystalline alpha alumina particles. Ceramic crushed abrasive particles composed of crystallites of alpha alumina, magnesium alumina spinel, and a rare earth hexagonal aluminate may be prepared using sol-gel precursor alpha alumina particles according to methods described in, for example, U.S. Pat. No. 5,213,591 (Celikkaya et al.) and U.S. Publ. Pat. Appln. Nos. 2009/0165394 A1 (Culler et al.) and 2009/0169816 A1 (Erickson et al.).

Further details concerning methods of making sol-gel-derived abrasive particles can be found in, for example, U.S. Pat. No. 4,314,827 (Leitheiser); U.S. Pat. No. 5,152,917 (Pieper et al.); U.S. Pat. No. 5,435,816 (Spurgeon et al.); U.S. Pat. No. 5,672,097 (Hoopman et al.); U.S. Pat. No. 5,946,991 (Hoopman et al.); U.S. Pat. No. 5,975,987 (Hoopman et al.); and U.S. Pat. No. 6,129,540 (Hoopman et al.); and in U.S. Publ. Pat. Appln. No. 2009/0165394 A1 (Culler et al.).

The amount of platey crushed abrasive particles contained in the initial (e.g., initially applied) crushed abrasive particles is preferably at least 50 number percent, at least 55 number percent, at least 60 number percent, at least 65 number percent, at least 70 number percent, at least 75 number percent, at least 80 number percent, at least 85 number percent, at least 90 number percent, at least 95 number percent, at least 99 number percent, or even 100 number percent, based on the total number of the initial crushed abrasive particles.

Exemplary commercially available crushed abrasive particles containing a majority of platey crushed abrasive particles can be obtained from Washington Mills, Niagara Falls N.Y. (e.g., as Silicon carbide abrasive particles, ANSI grade 24), and from 3M Company, Saint Paul, Minn. (e.g., as 3M CERAMIC ABRASIVE GRAIN 323, grade 24).

If desired, shaped abrasive particles may be used in conjunction with the crushed abrasive particles. Examples of shaped abrasive particles can be found in U.S. Pat. No. 5,201,916 (Berg); U.S. Pat. No. 5,366,523 (Rowenhorst (Re 35,570)); and U.S. Pat. No. 5,984,988 (Berg). U.S. Pat. No. 8,034,137 (Erickson et al.) describes alumina crushed abrasive particles that have been formed in a specific shape, then crushed to form shards that retain a portion of their original shape features. In some embodiments, shaped alpha alumina particles are precisely-shaped (i.e., the particles have shapes that are at least partially determined by the shapes of cavities in a production tool used to make them. Details concerning such crushed abrasive particles and methods for their preparation can be found, for example, in U.S. Pat. No. 8,142,531 (Adefris et al.); U.S. Pat. No. 8,142,891 (Culler et al.); and U.S. Pat. No. 8,142,532 (Erickson et al.); and in U.S. Pat. Appl. Publ. Nos. 2012/0227333 (Adefris et al.); 2013/0040537 (Schwabel et al.); and 2013/0125477 (Adefris).

Surface coatings on the various abrasive particles may be used to improve the adhesion between the abrasive particles and a binder in abrasive articles, or can be used to aid in electrostatic deposition. In one embodiment, surface coatings as described in U.S. Pat. No. 5,352,254 (Celikkaya) in an amount of 0.1 to 2 percent surface coating to abrasive particle weight may be used. Such surface coatings are described in U.S. Pat. No. 5,213,591 (Celikkaya et al.); U.S. Pat. No. 5,011,508 (Wald et al.); U.S. Pat. No. 1,910,444

(Nicholson); U.S. Pat. No. 3,041,156 (Rowse et al.); U.S. Pat. No. 5,009,675 (Kunz et al.); U.S. Pat. No. 5,085,671 (Martin et al.); U.S. Pat. No. 4,997,461 (Markhoff-Matheny et al.); and U.S. Pat. No. 5,042,991 (Kunz et al.). Additionally, the surface coating may prevent the shaped abrasive particle from capping. Capping is the term to describe the phenomenon where metal particles from the workpiece being abraded become welded to the tops of the crushed abrasive particles. Surface coatings to perform the above functions are known to those of skill in the art.

Crushed abrasive particles used in practice of the present disclosure (e.g., the initial crushed abrasive particles and the optional crushed filler particles) are preferably selected to have a length and/or width in a range of from 0.1 micron to 3500 microns, more typically 100 microns to 3000 microns, and more typically 100 microns to 2600 microns, although other lengths and widths may also be used.

The platey crushed abrasive particles are typically selected to have a thickness in a range of from 0.1 micron to 1600 microns, more typically from 1 micron to 1200 microns, although other thicknesses may be used. In some embodiments, platey crushed abrasive particles may have an aspect ratio (length to thickness) of at least 2, 3, 4, 5, 6, or more.

Length, width, and thickness of the crushed abrasive particles can be determined on an individual or average basis, as desired. Suitable techniques may include inspection and measurement of individual particles, as well as using automated image analysis techniques (e.g., using a dynamic image analyzer such as a CAMSIZER XT image analyzer from Retsch Technology Gmbh of Haan, Germany) according to test method ISO 13322-2:2006 "Particle size analysis—Image analysis methods—Part 2: Dynamic image analysis methods".

The initial and/or crushed filler particles may be independently sized according to an abrasives industry recognized specified nominal grade. Exemplary abrasive industry recognized grading standards include those promulgated by ANSI (American National Standards Institute), FEPA (Federation of European Producers of Abrasives), and JIS (Japanese Industrial Standard). ANSI grade designations (i.e., specified nominal grades) include, for example: ANSI 4, ANSI 6, ANSI 8, ANSI 16, ANSI 24, ANSI 36, ANSI 46, ANSI 54, ANSI 60, ANSI 70, ANSI 80, ANSI 90, ANSI 100, ANSI 120, ANSI 150, ANSI 180, ANSI 220, ANSI 240, ANSI 280, ANSI 320, ANSI 360, ANSI 400, and ANSI 600. FEPA grade designations include F4, F5, F6, F7, F8, F10, F12, F14, F16, F16, F20, F22, F24, F30, F36, F40, F46, F54, F60, F70, F80, F90, F100, F120, F150, F180, F220, F230, F240, F280, F320, F360, F400, F500, F600, F800, F1000, F1200, F1500, and F2000. JIS grade designations include JIS8, JIS12, JIS16, JIS24, JIS36, JIS46, JIS54, JIS60, JIS80, JIS100, JIS150, JIS180, JIS220, JIS240, JIS280, JIS320, JIS360, JIS400, JIS600, JIS800, JIS1000, JIS1500, JIS2500, JIS4000, JIS6000, JIS8000, and JIS10,000

According to an embodiment of the present disclosure, the average diameter of the crushed abrasive particles may be within a range of from 260 to 1400 microns in accordance with FEPA grades F60 to F24.

Alternatively, the initial and/or optional crushed filler particles (e.g., crushed abrasive filler particles) can be graded to a nominal screened grade using U.S.A. Standard Test Sieves conforming to ASTM E-11 "Standard Specification for Wire Cloth and Sieves for Testing Purposes". ASTM E-11 prescribes the requirements for the design and construction of testing sieves using a medium of woven wire cloth mounted in a frame for the classification of materials according to a designated particle size. A typical designation may be represented as −18+20 meaning that the crushed abrasive particles pass through a test sieve meeting ASTM E-11 specifications for the number 18 sieve and are retained on a test sieve meeting ASTM E-11 specifications for the number 20 sieve. In one embodiment, the crushed abrasive particles have a particle size such that most of the particles pass through an 18 mesh test sieve and can be retained on a 20, 25, 30, 35, 40, 45, or 50 mesh test sieve. In various embodiments, the crushed abrasive particles can have a nominal screened grade of: −18+20, −20/+25, −25+30, −30+35, −35+40, 5−40+45, −45+50, −50+60, −60+70, −70/+80, −80+100, −100+120, −120+140, −140+170, −170+200, −200+230, −230+270, −270+325, −325+400, −400+450, −450+500, or −500+635. Alternatively, a custom mesh size can be used such as −90+100.

Softer inorganic crushed abrasive particles may also be used as optional crushed filler particles. Examples of suitable materials include silica, iron oxide, chromia, ceria, zirconia, titania, tin oxide, metal carbonates (such as calcium carbonate (chalk, calcite, marl, travertine, marble and limestone), calcium magnesium carbonate, sodium carbonate, magnesium carbonate), silicates (such as talc, clays, (montmorillonite) feldspar, mica, calcium silicate, calcium metasilicate, sodium aluminosilicate, sodium silicate), metal sulfates (such as calcium sulfate, barium sulfate, sodium sulfate, aluminum sodium sulfate, aluminum sulfate), gypsum, aluminum trihydrate, graphite, metal oxides (such as calcium oxide (lime), titanium dioxide, metal sulfites (such as calcium sulfite), metal particles (tin, lead, copper and the like), glass particles, flint, talc, emery, and combinations thereof. Organic thermoset resins and thermoplastics in crushed particulate form may also be used as crushed filler particles.

Coated abrasive articles according to the present disclosure include a backing, a make layer, crushed abrasive particles, a size layer, and an optional supersize layer.

Figure 13:
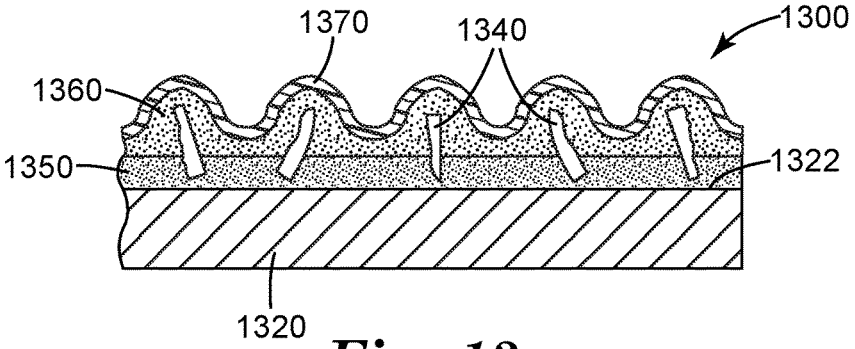
FIG. 13 is a schematic side view of exemplary coated abrasive article 1300 according to the present disclosure.

Referring now FIG. 13, exemplary coated abrasive article 1300 has backing 1320 with first major surface 1322. Crushed abrasive particles 1340 are secured to first major surface 1322 of backing 1320 by make layer 1350 and size layer 1360. Optional supersize layer 1370 is disposed on size layer 1360.

Figure 14:
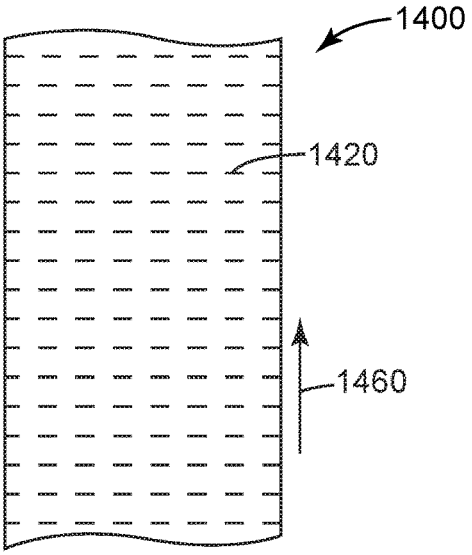
FIG. 14 is a schematic cutaway top view of exemplary coated belt 1400 according to the present disclosure.
Figure 15:
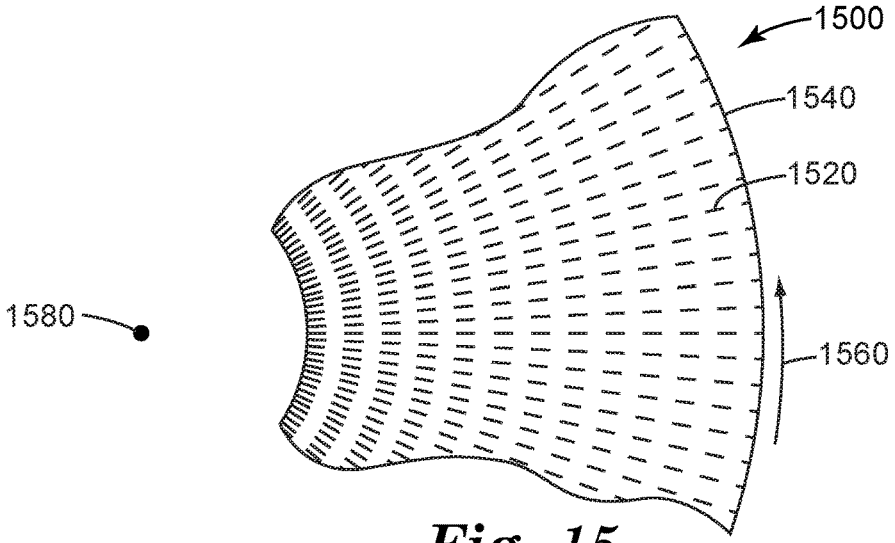
FIG. 15 is a schematic top view of exemplary coated abrasive disc 1500 according to the present disclosure.

Coated abrasive articles may have a direction of intended use. For example, as shown in FIG. 14, exemplary coated abrasive belt 1400 comprises platey crushed abrasive particles 1420, and has a longitudinal direction of intended use 1460. Platey crushed abrasive particles 1420 are oriented substantially perpendicularly to longitudinal direction of intended use 1460. Likewise, as shown in FIG. 15, exemplary coated abrasive disc 1500 comprises platey crushed abrasive particles 1520, and has a rotational direction of intended use 1560 around a central axis 1580. Platey crushed abrasive particles 1520 are oriented substantially perpendicularly to rotational direction of intended use 1560. While platey crushed abrasive particles 1520 are shown in the drawings as aligned in rows, this is not a requirement. Many other coated abrasive articles (e.g., those coated abrasive articles specifically designed for use with sanding blocks) may also have specified directions of intended use.

In making a coated abrasive article, a make layer precursor comprising a first binder precursor is applied to a major surface of the backing. Abrasive particles are then at least partially embedded into the make layer precursor (e.g., by electrostatic coating), and the first binder precursor is at least partially cured to secure the particles to the make layer precursor. If utilized, an optional size layer precursor comprising a second binder precursor (which may be the same or different from the first binder precursor) is then applied over the make layer precursor and abrasive particles, followed by curing the binder precursors to provide the make and size layers.

Optionally, coated abrasive articles may further comprise, for example, a backsize (i.e., a coating on the major surface of the backing opposite the major surface having the abrasive coat), a presize or a tie layer (i.e., a coating between the make layer and the backing), and/or a saturant which coats both major surfaces of the backing. Coated abrasive articles may further comprise a supersize covering the abrasive layer. If present, the supersize typically includes grinding aids and/or anti-loading materials.

Suitable make and size layer resins include, for example, phenolic resins, acrylic resins, cyanate resins, and urethane resins.

Coated abrasive articles according to the present invention may be converted, for example, into belts, rolls, discs (including perforated discs), and/or sheets. For belt applications, two free ends of the abrasive sheet may be joined together using known methods to form a spliced belt.

In addition to the description contained hereinabove, further description of techniques and materials for making coated abrasive articles may be found in, for example, U.S. Pat. No. 4,314,827 (Leitheiser et al.); U.S. Pat. No. 4,518,397 (Leitheiser et al.); U.S. Pat. No. 4,623,364 (Cottringer et al.); U.S. Pat. No. 4,652,275 (Bloecher et al.); U.S. Pat. No. 4,734,104 (Broberg); U.S. Pat. No. 4,737,163 (Larkey); U.S. Pat. No. 4,744,802 (Schwabel); U.S. Pat. No. 4,770,671 (Monroe et al.); U.S. Pat. No. 4,799,939 (Bloecher et al.); U.S. Pat. No. 4,881,951 (Wood et al.); U.S. Pat. No. 4,927,431 (Buchanan et al.); U.S. Pat. No. 5,498,269 (Larmie); U.S. Pat. No. 5,011,508 (Wald et al.); U.S. Pat. No. 5,078,753 (Broberg et al.); U.S. Pat. No. 5,090,968 (Pellow); U.S. Pat. No. 5,108,463 (Buchanan et al.); U.S. Pat. No. 5,137,542 (Buchanan et al.); U.S. Pat. No. 5,139,978 (Wood); U.S. Pat. No. 5,152,917 (Pieper et al.); U.S. Pat. No. 5,203,884 (Buchanan et al.); U.S. Pat. No. 5,227,104 (Bauer); and U.S. Pat. No. 5,328,716 (Buchanan).

Select Embodiments of the Present Disclosure

In a first embodiment, the present disclosure provides a coated abrasive article comprising:

a backing having first and second opposed major surfaces;

a make layer secured to at least a portion of the first major surface of the backing;

crushed abrasive particles comprising, on a total weight basis:

35 to 100 weight percent of initial crushed abrasive particles having a first composition and first size grade, wherein a majority of the initial crushed abrasive particles are platey crushed abrasive particles, and wherein each platey crushed abrasive particle has a respective length, width, and thickness; and 0 to 65 weight percent of crushed filler particles having a second composition and a second size grade, wherein:

i) the first and second compositions are different;

ii) the first and second size grades are different; or iii) both of i) and ii);

a size layer disposed on and secured to at least a portion of the make layer and platey crushed abrasive particles, wherein the coated abrasive article has a direction of intended use, and wherein a majority of the platey crushed abrasive particles are positioned with their thickness oriented substantially parallel to the direction of intended use.

In a second embodiment, the present disclosure provides a coated abrasive article according to the first embodiment, further comprising a supersize layer disposed on at least a portion of the size layer.

In a third embodiment, the present disclosure provides a coated abrasive article according to the first or second embodiment, wherein the coated abrasive article is essentially free of shaped abrasive particles.

In a fourth embodiment, the present disclosure provides a coated abrasive article according to any one of the first to third embodiments, wherein the platey crushed abrasive particles comprise alumina.

In a fifth embodiment, the present disclosure provides a method of making a coated abrasive article, the method comprising the steps:

a) providing a production tool having a working surface, wherein the first major surface defines a plurality of oriented cavities, wherein the oriented cavities have respective elongate outer openings at the working surface, and wherein the respective elongate outer openings have respective maximum lengths oriented along respective longitudinal directions;

b) providing a backing having a make layer precursor disposed on at least a portion of a first major surface thereof;

c) disposing a plurality of initial crushed abrasive particles into at least a portion of the plurality of oriented cavities to form a loaded production tool, wherein the initial crushed abrasive particles have a first composition and first size grade, wherein a majority of the initial crushed abrasive particles are platey crushed abrasive particles, wherein each platey crushed abrasive particle has a respective length, width, and thickness, and wherein a majority of the platey crushed abrasive particles contained within the plurality of oriented cavities are respectively aligned substantially parallel to the longitudinal direction of the opening of the cavity in which it is disposed;

d) transferring at least a portion of the initial crushed abrasive particles disposed within the plurality of oriented cavities of the loaded production tool onto at least a portion of the make layer precursor;

e) at least partially curing the make layer precursor;

f) disposing a size layer precursor onto at least a portion of the make layer precursor and platey crushed abrasive particles; and g) at least partially curing the size layer precursor.

In a sixth embodiment, the present disclosure provides a method according to the fifth embodiment, further comprising, after step d) and before step e), adhering crushed filler particles to the make layer precursor, wherein the crushed filler particles have a second composition and a second size grade, and wherein:

i) the first and second compositions are different;

ii) the first and second size grades are different; or iii) both of i) and ii).

In a seventh embodiment, the present disclosure provides a method according to the sixth embodiment, wherein the total weight of the initial crushed abrasive particles is greater than the total weight of the crushed filler particles.

In an eighth embodiment, the present disclosure provides a method according to any one of the fifth to seventh embodiments, wherein the coated abrasive article has a direction of intended use, and wherein a majority of the platey crushed abrasive particles of the coated abrasive article are positioned with their thickness oriented substantially parallel to the direction of intended use.

In a ninth embodiment, the present disclosure provides a method according to any one of the fifth to eighth embodiments, wherein the oriented cavities have closed bottoms.

In a tenth embodiment, the present disclosure provides a method according to any one of the fifth to ninth embodiments, wherein the elongate outer openings of at least a portion of the oriented cavities are rectangular.

In an eleventh embodiment, the present disclosure provides a method according to any one of the fifth to tenth embodiments, wherein a majority of the oriented cavities of the loaded production tool each contain a respective single platey crushed abrasive particle.

In a twelfth embodiment, the present disclosure provides a method according to any one of the fifth to eleventh embodiments, wherein a majority of the platey crushed abrasive particles are disposed completely within respective oriented cavities.

In a thirteenth embodiment, the present disclosure provides a method according to any one of the fifth to twelfth embodiments, wherein the loaded production tool is essentially free of shaped abrasive particles.

In a fourteenth embodiment, the present disclosure provides a method according to any one of the fifth to thirteenth embodiments, wherein the platey crushed abrasive particles comprise alumina.

Objects and advantages of this disclosure are further illustrated by the following non-limiting examples, but the particular materials and amounts thereof recited in these examples, as well as other conditions and details, should not be construed to unduly limit this disclosure.

EXAMPLES

Unless otherwise noted, all parts, percentages, ratios, etc. in the Examples and the rest of the specification are by weight. In the Tables, the abbreviation "nd" means not determined and "gsm" refers to grams per square meter. Materials used in the examples are listed in Table 1. In Table 1, below, the percentage of platey particles (on a number basis) was determined by visual inspection of at least 100 randomly selected particles.

TABLE 1

| DESIGNATION | DESCRIPTION | Numerical Percentage of Platey Particles |
|---|---|---|
| AP1 | Silicon carbide crushed abrasive particles, ANSI grade 24, obtained from Washington Mills, Niagara Falls, New York | ≥90% |
| AP2 | Silicon carbide crushed abrasive particles, FEPA grade 50, obtained from Washington Mills, Niagara Falls, New York | |
| AP3 | Ceramic aluminum oxide crushed abrasive particles, ANSI grade 24, obtained as 3M CERAMIC ABRASIVE GRAIN 323, grade 24 from 3M Company, Saint Paul, Minnesota | ≥85% |
| AP4 | Aluminum oxide crushed abrasive particles, ANSI grade 40, obtained as 40 ALUN CX from Washington Mills, Niagara Falls, New York | |
| AP5 | Ceramic aluminum oxide crushed abrasive particles, ANSI grade 24, obtained as 3M CERAMIC ABRASIVE GRAIN 222, grade 24 from 3M Company | ≥85% |

TABLE 1-continued

| DESIGNATION | DESCRIPTION | Numerical Percentage of Platey Particles |
|---|---|---|
| AP6 | Semi-friable aluminum oxide crushed abrasive particles, ANSI grade 40 obtained as BFRPL GRADE 40 from Imerys Fused Minerals Villach GmbH, Villach, Austria | |
| AP7 | Fused alumina-zirconia eutectic crushed abrasive particles, ANSI grade 24, obtained from Imerys Fused Minerals Villach GmbH, Villach, Austria | ≥80% |
| AP8 | Ceramic aluminum oxide crushed abrasive particles, ANSI grade 24, obtained as 3M CERAMIC ABRASIVE GRAIN 351, grade 24 from 3M Company | ≥85% |
| AP9 | FSX fused brown aluminum oxide crushed abrasive particles, ANSI grade 24, obtained from Treibacher Schleifmittel North America Inc., Niagara Falls, New York | ≥60% |
| AP10 | Ceramic aluminum oxide abrasive flake grain having the chemical composition of AP8 but coated in the form of a thin film, dried and crushed as described in U.S. Pat. No. 4,848,041 (Kruschke) and screened to +25/−30 with a thickness range of 100-400 micrometers. | ≥95% |
| AP11 | Ceramic aluminum oxide abrasive flake grain having a composition as described in U.S. Pat. No. 4,964,883 (Morris et al.) containing 2% iron oxide seed and 4.5% MgO, coated in the form of a thin film, dried and crushed as described in U.S. Pat. No. 4,848,041 (Kruschke) and graded to ANSI grade 24 with a thickness range of 125-300 micrometers | ≥95% |
| AP12 | Semi-friable aluminum oxide crushed abrasive particles, ANSI grade 50 obtained as BFRPL GRADE 50 from Imerys Fused Minerals Villach GmbH, Villach, Austria | |

Test Methods

Abrasive Belt Test 1 (Wood)

A 3-inch (7.6-cm) wide endless abrasive belt to be tested was mounted on a belt sander fitted with an 8-inch (20.6-cm) diameter steel contact wheel. A 16 inches (40.6 cm) long×⅝ inch (1.6 cm) thick particle board workpiece was secured to a test fixture in a position to be abraded on its edge by the endless abrasive belt. The test fixture was adjusted to provide a 5 mm interference between the proximal surface of the edge of the workpiece and the surface of the abrasive belt. The belt sander was activated to a surface speed of 5750 feet/minute (1753 m/min) and the workpiece traversed along the 16 inches (40.6 cm) dimension at a rate of 150 mm/sec counter to the belt direction. The normal force at the abrasive belt/workpiece interface was measured as the specified volume of wood was abraded away. Following this first pass, the edge of the particle board was retracted from the abrasive belt, returned to its starting position, adjusted to provide another 5 mm interference, and traversed for another abrasion pass. This process was repeated for a total of 80 passes.

Abrasive Belt Test 2 (Metals)

Abrasive Belt Test 2 was used to evaluate the efficacy of abrasive belts. Test belts were of dimensions 10.16 cm×91.44 cm. The workpiece (either 1018 mild steel, 1045 carbon steel, 304 stainless steel, or titanium, as specified) was a bar that was presented to the abrasive belt along its 1.9 cm×1.9 cm end. A 20.3-cm diameter, 70 durometer Shore A, serrated (1:1 land to groove ratio) rubber contact wheel was used. The belt was run at 5500 SFM for 1018 mild steel, 1045 carbon steel and 304 stainless steel and 1885 SFM for titanium. The workpiece was urged against the center part of the belt at a blend of normal forces from 10 to 15 pounds (4.53 to 6.8 kg). The test consisted of measuring the weight loss of the workpiece after 15 seconds of grinding (1 cycle). The workpiece was then cooled and tested again. The test was concluded after the number of test cycles specified in Table 3 or 5 or when the cut dropped below 20 percent of the cycle 1 cut. The cut in grams was recorded after each cycle.

Comparative Example A

Untreated polyester cloth having a basis weight of 300-400 grams per square meter (g/m$^2$), obtained under the trade designation POWERSTRAIT from Milliken & Company, Spartanburg, S.C., was presized with a composition consisting of 75 parts EPON 828 epoxy resin (bisphenol A diglycidyl ether, from Resolution Performance Products, Houston, Tex.), 10 parts of trimethylolpropane triacrylate (obtained as SR351 from Cytec Industrial Inc., Woodland Park, N.J.), 8 parts of dicyandiamide curing agent (obtained as DICYANEX 1400B from Air Products and Chemicals, Allentown, Pa.), 5 parts of novolac resin (obtained as RUTAPHEN 8656 from Momentive Specialty Chemicals Inc., Columbus, Ohio), 1 part of 2,2-dimethoxy-2-phenylacetophenone (obtained as IRGACURE 651 photoinitiator from BASF Corp., Florham Park, N.J.), and 0.75 part of 2-propylimidazole (obtained as ACTIRON NXJ-60 LIQUID from Synthron, Morganton, N.C.). A 10.16 cm×114.3 cm strip of this backing was taped to a 15.2 cm×121.9 cm×1.9 cm thick laminated particle board. The cloth backing was coated with 237 g/m$^2$ of a phenolic make resin consisting of 52 parts of resole phenolic resin (obtained as GP 8339 R-23155B from Georgia Pacific Chemicals, Atlanta, Ga.), 45 parts of calcium metasilicate (obtained as WOLLASTOCOAT from NYCO Company, Willsboro, N.Y.), and 2.5 parts of water using a putty knife to fill the backing weave and remove excess resin. Abrasive particles AP1 were applied to fill the cavities of a production tool with an array of vertically-oriented triangular openings generally configured as shown in FIGS. 3A-3C (wherein length=1.698 mm, width=0.621 mm, depth=1.471 mm, bottom width=0.363 mm) arranged in a rectangular array (length-wise pitch=2.68 mm, width-wise pitch=1.075 mm) was cut into 5 inch (12.7 cm) wide strips at a zero degree offset angle (long dimension oriented in the machine direction.) Sufficient bias-cut tool sections to achieve a total length of 44 inches (111 cm) were lined up end to end and mounted to a second 15.2 cm×121.9 cm×1.9 cm thick particle board. A 1.0 cm diameter hole was drilled through the thickness at the midpoint of the 15.2 cm dimension and approximately 2.54 cm from each end of both of the laminated particle boards. A base was constructed that had a 0.95-cm diameter vertical dowels at each end to engage the holes in the particle boards and thereby align the placement of first the abrasive particle filled tooling (open side up), followed by the make resin-coated backing (coated side down). Several spring clamps were attached to the particle boards to hold the construction together. The clamped assembly was removed from the dowels, flipped over (backing now coated side up and tooling open side down) and placed back onto the base using the dowels to maintain alignment. The back of the laminated particle board was repeatedly tapped lightly with a hammer to transfer the abrasive particles to the make-coated backing. AP1 (482 g/m$^2$) was thus applied. The spring clamps were removed and the top board carefully removed from the dowels so the transferred mineral was not knocked over on its side. An additional 346 g/m$^2$ of particles AP2 was then applied over the oriented particles by drop coating and inversion to remove excess AP2 to complete the abrasive particle addition. The tape was removed and the abrasive coated backing and it was placed in an oven at 90° C. for 1.5 hours to partially cure the make resin. A size resin consisting of 43.15 parts of resole phenolic resin (obtained as GP 8339 R-23155B from Georgia Pacific Chemicals, Atlanta, Ga.), 9.7 parts of water, 22.75 parts of cryolite (Solvay Fluorides, LLC, Houston, Tex.), 22.75 parts calcium metasilicate (obtained as WOLLASTOCOAT from NYCO Company, Willsboro, N.Y.) and 1.65 parts red iron oxide was applied to each strip at a basis weight of 456 g/m$^2$, and the coated strip was placed in an oven at 90° C. for 1 hour, followed by and 8 hours at 102° C. After cure, the strip of coated abrasive was converted into a belt using conventional adhesive splicing practices.

Examples 1-5 and Comparative Examples B-E

Examples 1-5 and Comparative Examples B-E were prepared according to the method of Comparative Example A, with the exceptions of offset angle and coating weights, as shown in Table 2. For Comparative Examples B and C, and Examples 1 and 5, a supersize coating consisting of 29.2 parts of an aqueous dispersion obtained as CMD35201 (EPI-REZ 522-C) (Rhone-Poulenc, Inc. Louisville, Ky.), 0.35 parts 2-ethyl, 4-methyl imidazole, obtained as EMI-24 (Air Products and Chemicals, Allentown, Pa.), 53.3 parts 98% pure micro-pulverized $KBF_4$ (95% by weight passes through a 325-mesh screen and 100% by weight passes through a 200-mesh screen) was then applied to each strip at a basis weight of 300 g/m$^2$ and then the coated strips were cured at 125° C. for 3 hours.

TABLE 2

| EXAMPLE | PLACED PARTICLE | PLACED PARTICLE WEIGHT, gsm | ORIENTATION OF PLACED PARTICLES, degrees | FILL PARTICLE | FILL PARTICLE WEIGHT, gsm | MAKE LAYER WEIGHT, gsm | SIZE LAYER WEIGHT, gsm | SUPERSIZE LAYER WEIGHT, gsm |
|---|---|---|---|---|---|---|---|---|
| COMP. EX. A | AP1 | 482 | 0 | AP2 | 346 | 237 | 456 | 0 |
| 1 | AP1 | 482 | 90 | AP2 | 346 | 237 | 456 | 0 |
| COMP. EX. B | AP3 | 716 | 0 | AP4 | 526 | 229 | 513 | 340 |
| 2 | AP3 | 716 | 90 | AP4 | 526 | 229 | 513 | 340 |
| COMP. EX. C | AP5 | 529 | 0 | AP6 | 753 | 230 | 404 | 0 |
| 3 | AP5 | 529 | 90 | AP6 | 753 | 230 | 404 | 0 |
| COMP. EX. D | AP7 | 746 | 0 | AP6 | 618 | 237 | 420 | 0 |

TABLE 2-continued

| EXAMPLE | PLACED PARTICLE | PLACED PARTICLE WEIGHT, gsm | ORIENTATION OF PLACED PARTICLES, degrees | FILL PARTICLE | FILL PARTICLE WEIGHT, gsm | MAKE LAYER WEIGHT, gsm | SIZE LAYER WEIGHT, gsm | SUPERSIZE LAYER WEIGHT, gsm |
|---|---|---|---|---|---|---|---|---|
| 4 | AP7 | 746 | 90 | AP6 | 618 | 237 | 420 | 0 |
| COMP. EX. E | AP8 | 646 | 0 | AP6 | 623 | 220 | 435 | 430 |
| 5 | AP8 | 646 | 90 | AP6 | 623 | 220 | 435 | 430 |

TABLE 3

| EXAMPLE | ABRASIVE BELT TEST METHOD | NO. OF TEST CYCLES | NO. OF BELTS TESTED | WORKPIECE | ORIENTATION OF PLACED PARTICLE, degrees | AVERAGE TOTAL CUT, grams | AVERAGE NORMAL FORCE, lb (kg) |
|---|---|---|---|---|---|---|---|
| COMP. EX. A | 1 | 80 | 2 | particle board | 0 | nd | 18.1 (8.2) |
| 1 | 1 | 80 | 2 | particle board | 90 | nd | 15.5 (7.0) |
| COMP. EX. B | 2 | 20 | 2 | titanium | 0 | 26.5 | nd |
| 2 | 2 | 20 | 3 | titanium | 90 | 32.4 | nd |
| COMP. EX. C | 2 | 60 | 2 | 1045 carbon steel | 0 | 347 | nd |
| 3 | 2 | 60 | 2 | 1045 carbon steel | 90 | 587 | nd |
| COMP. EX. D | 2 | 60 | 2 | 1045 carbon steel | 0 | 362 | nd |
| 4 | 2 | 60 | 2 | 1045 carbon steel | 90 | 453 | nd |
| COMP. EX. E | 2 | 60 | 3 | 304 stainless steel | 0 | 410 | nd |
| 5 | 2 | 60 | 3 | 304 stainless steel | 90 | 632 | nd |

Comparative Example F

Untreated polyester cloth having a basis weight of 300-400 grams per square meter (g/m$^2$), obtained under the trade designation POWERSTRAIT from Milliken & Company, Spartanburg, S.C., was presized with a composition consisting of 75 parts EPON 828 epoxy resin (bisphenol A diglycidyl ether, from Resolution Performance Products, Houston, Tex.), 10 parts of trimethylolpropane triacrylate (obtained as SR351 from Cytec Industrial Inc., Woodland Park, N.J., 8 parts of dicyandiamide curing agent (obtained as DICYANEX 1400B from Air Products and Chemicals, Allentown, Pa.), 5 parts of novolac resin (obtained as RUTAPHEN 8656 from Momentive Specialty Chemicals Inc., Columbus, Ohio), 1 part of 2,2-dimethoxy-2-phenylacetophenone (obtained as IRGACURE 651 photoinitiator from BASF Corp., Florham Park, N.J.), and 0.75 part of 2-propylimidazole (obtained as ACTIRON NXJ-60 LIQUID from Synthron, Morganton, N.C.). A 10.16 cm×114.3 cm strip of this backing was taped to a 15.2 cm×121.9 cm×1.9 cm thick laminated particle board. The cloth backing was coated with 237 g/m$^2$ of a phenolic make resin consisting of 52 parts of resole phenolic resin (obtained as GP 8339 R-23155B from Georgia Pacific Chemicals, Atlanta, Ga.), 45 parts of calcium metasilicate (obtained as WOLLASTOCOAT from NYCO Company, Willsboro, N.Y.), and 2.5 parts of water using a putty knife to fill the backing weave and remove excess resin. Abrasive particles AP8 were applied to fill the cavities of a production tool with an array of vertically-oriented triangular openings generally configured as shown in FIGS. 3A-3C (wherein length=1.698 mm, width=0.621 mm, depth=1.471 mm, bottom width=0.363 mm) arranged in a rectangular array (length-wise pitch=2.68 mm, width-wise pitch=1.075 mm) was cut into 5 inch (12.7 cm) wide strips at a zero degree offset angle (long dimension oriented in the machine direction.) Sufficient bias-cut tool sections to achieve a total length of 44 inches (111 cm) were lined up end to end and mounted to a second 15.2 cm×121.9 cm×1.9 cm thick particle board. A 1.0 cm diameter hole was drilled through the thickness at the midpoint of the 15.2 cm dimension and approximately 2.54 cm from each end of both of the laminated particle boards. A base was constructed that had a 0.95-cm diameter vertical dowels at each end to engage the holes in the particle boards and thereby align the placement of first the abrasive particle filled tooling (open side up), followed by the make resin-coated backing (coated side down). Several spring clamps were attached to the particle boards to hold the construction together. The clamped assembly was removed from the dowels, flipped over (backing now coated side up and tooling open side down) and placed back onto the base using the dowels to maintain alignment. The back of the laminated particle board was repeatedly tapped lightly with a hammer to transfer the abrasive particles to the make-coated backing. AP8 (500 g/m$^2$) was thus applied. The spring clamps were removed and the top board carefully removed from the dowels so the transferred mineral was not knocked over on its side. The tape was removed and the abrasive coated backing and it was placed in an oven at 90° C. for 1.5 hours to partially cure the make resin. A size resin consisting of 43.15 parts of resole phenolic resin (obtained as GP 8339 R-23155B from Georgia Pacific Chemicals, Atlanta, Ga.), 9.7 parts of water, 22.75 parts of cryolite (Solvay Fluorides, LLC, Houston, Tex.), 22.75 parts calcium metasilicate (obtained as WOLLASTOCOAT from NYCO Company, Willsboro, N.Y.) and 1.65 parts red iron oxide was applied to the strip at a basis weight of 680 g/m$^2$, and the coated strip was placed in an oven at 90° C. for 1 hour, followed by and 8 hours at 102° C. After cure, the strip of coated abrasive was converted into a belt using conventional adhesive splicing practices.

Examples 6-8 and Comparative Examples G-H

Examples 6-8 and Comparative Examples G-H were prepared according to the method of Comparative Example F, with the exceptions of offset angle and coating weights, as shown in Table 4, below.

TABLE 4

| EXAMPLE | PLACED PARTICLE | PLACED PARTICLE WEIGHT, gsm | ORIENTATION OF PLACED PARTICLES, degrees | MAKE LAYER WEIGHT, gsm | SIZE LAYER WEIGHT, gsm |
|---|---|---|---|---|---|
| COMP. EX. F | AP8 | 500 | 0 | 230 | 680 |
| COMP. EX. G | AP8 | 500 | 0 | 230 | 720 |
| 6 | AP8 | 560 | 90 | 180 | 710 |
| 7 | AP8 | 550 | 90 | 270 | 730 |
| COMP. EX. H | AP9 | 380 | 0 | 240 | 710 |
| 8 | AP9 | 440 | 90 | 210 | 710 |

TABLE 5

| EXAMPLE | ABRASIVE BELT TEST METHOD | NO. OF TEST CYCLES | NO. OF BELTS TESTED | WORKPIECE | ORIENTATION OF PLACED PARTICLE, degrees | TOTAL CUT, grams |
|---|---|---|---|---|---|---|
| COMP. EX. F | 2 | 100 | 1 | 1018 mild steel | 0 | 1169 |
| COMP. EX. G | 2 | 100 | 1 | 1018 mild steel | 0 | 1120 |
| 6 | 2 | 100 | 1 | 1018 mild steel | 90 | 2541 |
| 7 | 2 | 100 | 1 | 1018 mild steel | 90 | 1964 |
| COMP. EX. H | 2 | 38 (*) | 1 | 1018 mild steel | 0 | 155 |
| 8 | 2 | 57 (*) | 1 | 1018 mild steel | 90 | 381 |

(*) Test ended when cut dropped below 20% of cycle 1 cut.

Examples 9-11 and Comparative Examples I-K

Examples 9-11 and Comparative Examples I-K were prepared according to the method of Comparative Example A, with the exceptions of offset angle and coating weights, as shown in Table 6. Results of testing on individual belts are reported in Table 7.

Examples 12-13 and Comparative Examples L-M

Examples 12-13 and Comparative Examples L-M were prepared according to the method of Comparative Example F, with the exceptions of offset angle and coating weights, as shown in Table 8. Results of testing on individual belts are reported in Table 9.

TABLE 6

| EXAMPLE | PLACED PARTICLE | PLACED PARTICLE WEIGHT, gsm | ORIENTATION OF PLACED PARTICLES, degrees | FILL PARTICLE | FILL PARTICLE WEIGHT, gsm | MAKE LAYER WEIGHT, gsm | SIZE LAYER WEIGHT, gsm | SUPERSIZE LAYER WEIGHT, gsm |
|---|---|---|---|---|---|---|---|---|
| COMP. EX. I | AP11 | 530 | 0 | AP12 | 670 | 235 | 420 | 0 |
| COMP. EX. J | AP11 | 430 | 0 | AP12 | 700 | 220 | 410 | 0 |
| 9 | AP11 | 525 | 90 | AP12 | 640 | 200 | 465 | 0 |
| 10 | AP11 | 525 | 90 | AP12 | 620 | 185 | 455 | 0 |
| COMP. EX. K | AP10 | 575 | 0 | AP12 | 670 | 240 | 410 | 300 |
| 11 | AP10 | 530 | 90 | AP12 | 685 | 225 | 455 | 320 |

TABLE 7

| EXAMPLE | ABRASIVE BELT TEST METHOD | NO. OF TEST CYCLES | WORKPIECE | ORIENTATION OF PLACED PARTICLE, degrees | TOTAL CUT, grams |
|---|---|---|---|---|---|
| COMP. EX. I | 2 | 100 | 1018 mild steel | 0 | 970 |
| COMP. EX. J | 2 | 100 | 1018 mild steel | 0 | 924 |
| 9 | 2 | 100 | 1018 mild steel | 90 | 1816 |
| 10 | 2 | 100 | 1018 mild steel | 90 | 1646 |
| COMP. EX. K | 2 | 60 | 304 stainless steel | 0 | 303 |
| 11 | 2 | 60 | 304 stainless steel | 90 | 721 |

TABLE 8

| EXAMPLE | PLACED PARTICLE | PLACED PARTICLE WEIGHT, gsm | ORIENTATION OF PLACED PARTICLES, degrees | MAKE LAYER WEIGHT, gsm | SIZE LAYER WEIGHT, gsm | SUPERSIZE LAYER WEIGHT, gsm |
|---|---|---|---|---|---|---|
| COMP. EX. L | AP10 | 565 | 0 | 245 | 385 | 335 |
| COMP. EX. M | AP10 | 585 | 0 | 260 | 400 | 350 |
| 12 | AP10 | 640 | 90 | 280 | 470 | 355 |
| 13 | AP10 | 525 | 90 | 250 | 450 | 335 |

TABLE 9

| EXAMPLE | ABRASIVE BELT TEST METHOD | NO. OF TEST CYCLES | WORKPIECE | ORIENTATION OF PLACED PARTICLE, degrees | TOTAL CUT, grams |
|---|---|---|---|---|---|
| COMP. EX. L | 2 | 60 | 304 stainless steel | 0 | 317 |
| COMP. EX. M | 2 | 60 | 304 stainless steel | 0 | 310 |
| 12 | 2 | 60 | 304 stainless steel | 90 | 744 |
| 13 | 2 | 60 | 304 stainless steel | 90 | 655 |

All cited references, patents, and patent applications in the above application for letters patent are herein incorporated by reference in their entirety in a consistent manner. In the event of inconsistencies or contradictions between portions of the incorporated references and this application, the information in the preceding description shall control. The preceding description, given in order to enable one of ordinary skill in the art to practice the claimed disclosure, is not to be construed as limiting the scope of the disclosure, which is defined by the claims and all equivalents thereto.

What is claimed is:

1. A method of making a coated abrasive article, the method comprising the steps:

a) providing a production tool having a working surface, wherein the working surface defines a plurality of oriented cavities, wherein the oriented cavities have respective elongate outer openings at the working surface, and wherein the respective elongate outer openings have respective maximum lengths oriented along respective longitudinal directions;

b) providing a backing having a make layer precursor disposed on at least a portion of a first major surface thereof;

c) disposing a plurality of initial crushed abrasive particles into at least a portion of the plurality of oriented cavities to form a loaded production tool, wherein the initial crushed abrasive particles have a first composition and first size grade, wherein a majority of the initial crushed abrasive particles are platey crushed abrasive particles, wherein each platey crushed abrasive particle has a respective length, width, and thickness, and wherein a majority of the platey crushed abrasive particles contained within the plurality of oriented cavities are respectively aligned substantially parallel to the longitudinal direction of the opening of the cavity in which it is disposed;

d) transferring at least a portion of the initial crushed abrasive particles disposed within the plurality of oriented cavities of the loaded production tool onto at least a portion of the make layer precursor;

e) adhering crushed filler particles to the make layer precursor, wherein the crushed filler particles have a second composition and a second size grade, and wherein:

i) the first and second compositions are different;

ii) the first and second size grades are different; or iii) both of i) and ii);

f) at least partially curing the make layer precursor;

g) disposing a size layer precursor onto at least a portion of the make layer precursor and platey crushed abrasive particles; and h) at least partially curing the size layer precursor.

2. The method of claim 1, wherein the total weight of the initial crushed abrasive particles is greater than the total weight of the crushed filler particles.

3. The method of claim 1, wherein the coated abrasive article has a direction of intended use, and wherein a majority of the platey crushed abrasive particles of the coated abrasive article are positioned with their thickness oriented substantially parallel to the direction of intended use.

4. The method of claim 1, wherein the oriented cavities have closed bottoms.

5. The method of claim 1, wherein the elongate outer openings of at least a portion of the oriented cavities are rectangular.

6. The method of claim 1, wherein a majority of the oriented cavities of the loaded production tool each contain a respective single platey crushed abrasive particle.

7. The method of claim 1, wherein a majority of the platey crushed abrasive particles are disposed completely within respective oriented cavities.

8. The method of claim 1, wherein the platey crushed abrasive particles comprise alumina.

* * * * *